US006335717B2

(12) United States Patent
*Hasegawa et al.

(10) Patent No.: US 6,335,717 B2
(45) Date of Patent: Jan. 1, 2002

(54) LIQUID CRYSTAL DISPLAY DEVICE

(75) Inventors: Rei Hasegawa; Goh Itoh; Hisao Fujiwara; Yujiro Hara, all of Yokohama; Masahiko Akiyama, Tokyo; Tatsuo Saishu; Rieko Iida, both of Yokohama, all of (JP)

(73) Assignee: Kabushiki Kaisha Toshiba, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/103,373

(22) Filed: Jun. 24, 1998

(30) Foreign Application Priority Data

Jun. 30, 1997 (JP) ..... 9-174677

(51) Int. Cl.[7] ..... G09G 3/36
(52) U.S. Cl. ..... 345/97; 349/192
(58) Field of Search ..... 345/87–89, 90, 345/92, 94–97, 208, 211–213, 101; 349/187, 191–192, 133, 174, 167–168, 161, 172, 20–21, 123–127, 33, 42; 252/299.62

(56) References Cited

U.S. PATENT DOCUMENTS 5,477,235 A * 12/1995 Numao ..... 345/97
5,668,616 A * 9/1997 Nakamura et al. ..... 349/128
5,742,369 A * 4/1998 Mihara et al. ..... 349/123
5,805,129 A * 9/1998 Inaba et al. ..... 345/97
5,905,482 A * 5/1999 Hughes et al. ..... 345/89
5,922,242 A * 7/1999 Saishu et al. ..... 252/299.62
5,949,391 A * 9/1999 Saishu et al. ..... 345/50
5,963,290 A * 10/1999 Murai et al. ..... 349/191
5,990,856 A * 11/1999 Takeda et al. ..... 345/97
6,028,578 A * 2/2000 Ota et al. ..... 345/94

FOREIGN PATENT DOCUMENTS

JP 2-90124 * 3/1990
JP 3-296021 * 12/1991

* cited by examiner

*Primary Examiner*—Richard Hjerpe
*Assistant Examiner*—Frances Nguyen
(74) *Attorney, Agent, or Firm*—Finnegan, Henderson, Farabow, Garrett & Dunner, L.L.P.

(57) ABSTRACT

A liquid crystal display device is an active matrix type liquid crystal display device using a liquid crystal material having spontaneous polarization induced by application of an electric field or inherent thereto and includes a driving circuit for simultaneously selecting and driving a desired number of scanning lines among a plurality of scanning lines and a voltage applying circuit for applying a desired voltage for alignment of the liquid crystal material to a common electrode.

26 Claims, 17 Drawing Sheets

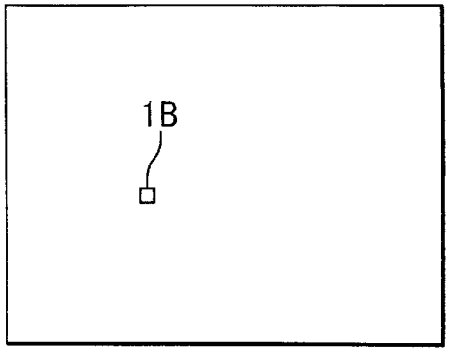
FIG. 1A
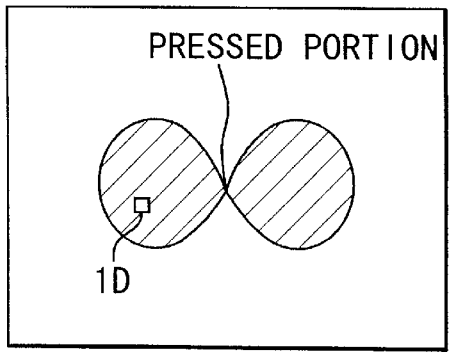
FIG. 1C
FIG. 1B
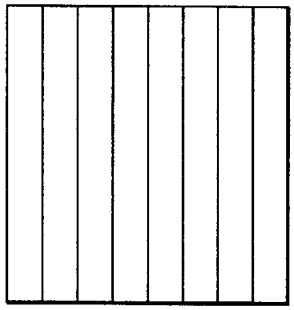
FIG. 1D
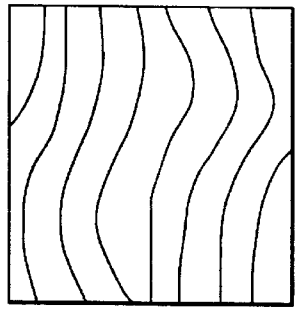
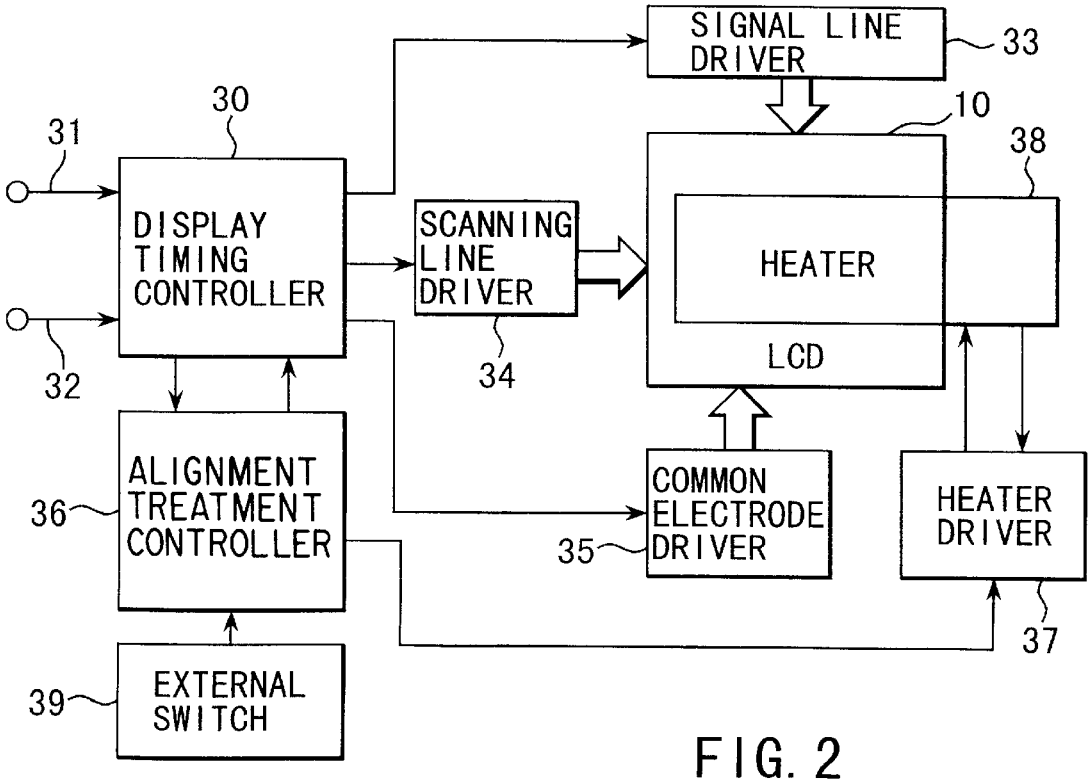
FIG. 2

| SAMPLE NO. | Vsig | | | Vcom | | | Vg | PANEL TEMPERATURE (°C) | CONTRAST | IMAGE QUALITY |
|---|---|---|---|---|---|---|---|---|---|---|
| | WAVEFORM | VOLTAGE (V) | FREQUENCY (Hz) | WAVEFORM | VOLTAGE (V) | FREQUENCY (Hz) | VOLTAGE (V) | | | |
| 1 | DC | 0 | – | RECTANGULAR | ±5 | 60 | DC20 | R.T.(25) | 70 TO 1 | C |
| 2 | DC | 0 | – | RECTANGULAR | ±10 | 60 | DC20 | R.T.(25) | 100 TO 1 | B |
| 3 | DC | 0 | – | RECTANGULAR | ±15 | 60 | DC20 | R.T.(25) | 200 TO 1 | A |
| 4 | RECTANGULAR | ±2.5 | 60 | RECTANGULAR | ±7.5 | 60 | DC20 | R.T.(25) | 100 TO 1 | B |
| 5 | DC | 0 | – | RECTANGULAR | +9,−11 | 60 | 2LAATSP Vgh=20 | R.T.(25) | 95 TO 1 | B |
| 6 | RECTANGULAR | ±2.5 | 60 | RECTANGULAR | +7,−8 | 60 | HLAATSP Vgh=20 | R.T.(25) | 90 TO 1 | B |
| 7 | DC | 0 | – | RECTANGULAR | ±10 | 1 | DC20 | R.T.(25) | 120 TO 1 | B |
| 8 | DC | 0 | – | RECTANGULAR | ±10 | 200 | DC20 | R.T.(25) | 80 TO 1 | B |
| 9 | DC | 0 | – | TRIANGULAR | ±10 | 60 | DC20 | R.T.(25) | 90 TO 1 | B |
| 10 | DC | 0 | – | SINUSOIDAL | ±10 | 60 | DC20 | R.T.(25) | 90 TO 1 | B |

2LAATSP : 2-LINES-AT-A-TIME SCANNING PULSE
HLAATSP : HALF-LINES-AT-A-TIME SCANNING PULSE
R.T. : ROOM TEMPERATURE

FIG. 5

| SAMPLE NO. | Vsig | | | Vcom | | | Vg | PANEL TEMPERATURE (°C) | CONTRAST | IMAGE QUALITY |
|---|---|---|---|---|---|---|---|---|---|---|
| | WAVEFORM | VOLTAGE (V) | FREQUENCY (Hz) | WAVEFORM | VOLTAGE (V) | FREQUENCY (Hz) | VOLTAGE (V) | | | |
| 1-2 | DC | 0 | - | RECTANGULAR | ±5 | 60 | DC20 | 50→R.T.(25) | 100 TO 1 | B |
| 2-2 | DC | 0 | - | RECTANGULAR | ±10 | 60 | DC20 | 50→R.T.(25) | 150 TO 1 | B |
| 3-2 | DC | 0 | - | RECTANGULAR | ±15 | 60 | DC20 | 50→R.T.(25) | 200 TO 1 | A |
| 4-2 | RECTANGULAR | ±2.5 | 60 | RECTANGULAR | ±7.5 | 60 | DC20 | 50→R.T.(25) | 150 TO 1 | B |
| 5-2 | DC | 0 | - | RECTANGULAR | +9,-11 | 60 | 2LAATSP Vgh=20 | 50→R.T.(25) | 140 TO 1 | A |
| 6-2 | RECTANGULAR | ±2.5 | 60 | RECTANGULAR | +7,-8 | 60 | HLAATSP Vgh=20 | 50→R.T.(25) | 135 TO 1 | A |
| 7-2 | DC | 0 | - | RECTANGULAR | ±10 | 1 | DC20 | 50→R.T.(25) | 180 TO 1 | A |
| 8-2 | DC | 0 | - | RECTANGULAR | ±10 | 200 | DC20 | 50→R.T.(25) | 100 TO 1 | B |
| 9-2 | DC | 0 | - | TRIANGULAR | ±10 | 60 | DC20 | 50→R.T.(25) | 120 TO 1 | B |
| 10-2 | DC | 0 | - | SINUSOIDAL | ±10 | 60 | DC20 | 50→R.T.(25) | 120 TO 1 | B |

2LAATSP : 2-LINES-AT-A-TIME SCANNING PULSE
HLAATSP : HALF-LINES-AT-A-TIME SCANNING PULSE
→ : TRANSITION TIME (10MIN)
R.T. : ROOM TEMPERTATURE

FIG. 6

| SAMPLE NO. | Vsig | | | Vcom | | | Vg | PANEL TEMPERATURE (℃) | CONTRAST | IMAGE QUALITY |
|---|---|---|---|---|---|---|---|---|---|---|
| | WAVEFORM | VOLTAGE (V) | FREQUENCY (Hz) | WAVEFORM | VOLTAGE (V) | FREQUENCY (Hz) | VOLTAGE (V) | | | |
| 1-3 | DC | 0 | - | RECTANGULAR | ±5 | 60 | DC20 | 90→R.T.(25) | 200 TO 1 | A |
| 2-3 | DC | 0 | - | RECTANGULAR | ±10 | 60 | DC20 | 90→R.T.(25) | 200 TO 1 | A |
| 3-3 | DC | 0 | - | RECTANGULAR | ±15 | 60 | DC20 | 90→R.T.(25) | 200 TO 1 | A |
| 4-3 | RECTANGULAR | ±2.5 | 60 | RECTANGULAR | ±7.5 | 60 | DC20 | 90→R.T.(25) | 200 TO 1 | A |
| 5-3 | DC | 0 | - | RECTANGULAR | +9,-11 | 60 | 2LAATSP Vgh=20 | 90→R.T.(25) | 200 TO 1 | A |
| 6-3 | RECTANGULAR | ±2.5 | 60 | RECTANGULAR | +7,-8 | 60 | HLAATSP Vgh=20 | 90→R.T.(25) | 200 TO 1 | A |
| 7-3 | DC | 0 | - | RECTANGULAR | ±10 | 1 | DC20 | 90→R.T.(25) | 200 TO 1 | A |
| 8-3 | DC | 0 | - | RECTANGULAR | ±10 | 200 | DC20 | 90→R.T.(25) | 200 TO 1 | A |
| 9-3 | DC | 0 | - | TRIANGULAR | ±10 | 60 | DC20 | 90→R.T.(25) | 200 TO 1 | A |
| 10-3 | DC | 0 | - | SINUSOIDAL | ±10 | 60 | DC20 | 90→R.T.(25) | 200 TO 1 | A |

2LAATSP : 2-LINES-AT-A-TIME SCANNING PULSE
HLAATSP : HALF-LINES-AT-A-TIME SCANNING PULSE
→ : TRANSITION TIME (10MIN)
R.T. : ROOM TEMPERATURE

FIG. 7

| SAMPLE NO. | Vsig | | | Vcom | | | Vg | PANEL | CONTRAST | IMAGE |
|---|---|---|---|---|---|---|---|---|---|---|
| | WAVEFORM | VOLTAGE (V) | FREQUENCY (Hz) | WAVEFORM | VOLTAGE (V) | FREQUENCY (Hz) | VOLTAGE (V) | TEMPERATURE (℃) | | QUALITY |
| C1 | RECTANGULAR | ±2.5 | 60 | DC | 0 | – | LAATSP Vgh=20 | R.T.(25) | 5 TO 1 | E |
| C2 | RECTANGULAR | ±5.0 | 60 | DC | 0 | – | LAATSP Vgh=25 | R.T.(25) | 50 TO 1 | D |
| C3 | RECTANGULAR | ±2.5 | 60 | RECTANGULAR | ±2.5 | 60 | LAATSP Vgh=20 | R.T.(25) | 50 TO 1 | D |
| C4 | RECTANGULAR | ±2.5 | 60 | DC | 0 | – | LAATSP Vgh=20 | 50→R.T.(25) | 10 TO 1 | E |
| C5 | RECTANGULAR | ±5.0 | 60 | DC | 0 | – | LAATSP Vgh=25 | 50→R.T.(25) | 60 TO 1 | D |
| C6 | RECTANGULAR | ±2.5 | 60 | RECTANGULAR | ±2.5 | 60 | LAATSP Vgh=20 | 50→R.T.(25) | 60 TO 1 | D |
| C7 | RECTANGULAR | ±2.5 | 60 | DC | 0 | – | LAATSP Vgh=20 | 90→R.T.(25) | 20 TO 1 | D |
| C8 | RECTANGULAR | ±5.0 | 60 | DC | 0 | – | LAATSP Vgh=25 | 90→R.T.(25) | 70 TO 1 | D |
| C9 | RECTANGULAR | ±2.5 | 60 | RECTANGULAR | ±2.5 | 60 | LAATSP Vgh=20 | 90→R.T.(25) | 70 TO 1 | D |

LAATSP : LINE–AT–A–TIME SCANNING PULSE
→ : TRANSITION TIME (10MIN)
R.T. : ROOM TEMPERATURE

FIG. 8

| SAMPLE NO. | Vcs | | | Vsig | | | Vcom | | | Vg | PANEL | CONTRAST | IMAGE |
|---|---|---|---|---|---|---|---|---|---|---|---|---|---|
| | WAVEFORM | VOLTAGE (V) | FREQUENCY (Hz) | WAVEFORM | VOLTAGE (V) | FREQUENCY (Hz) | WAVEFORM | VOLTAGE (V) | FREQUENCY (Hz) | VOLTAGE (V) | TEMPERATURE (℃) | | QUALITY |
| 11 | DC | 0 | – | DC | 0 | – | RECTANGULAR | ±5 | 60 | DC20 | R.T.(25) | 77 TO 1 | C |
| 12 | DC | 0 | – | DC | 0 | – | RECTANGULAR | ±10 | 60 | DC20 | R.T.(25) | 110 TO 1 | B |
| 13 | DC | 0 | – | DC | 0 | – | RECTANGULAR | ±15 | 60 | DC20 | R.T.(25) | 220 TO 1 | A |
| 14 | RECTANGULAR | ±3.5 | 60 | RECTANGULAR | ±2.5 | 60 | RECTANGULAR | ±7.5 | 60 | DC20 | R.T.(25) | 110 TO 1 | B |
| 15 | DC | 0 | – | FLOATING | | – | RECTANGULAR | ±10 | 60 | DC 0 | R.T.(25) | 105 TO 1 | B |
| 16 | RECTANGULAR | ±3.5 | 60 | FLOATING | | – | RECTANGULAR | ±7.5 | 60 | DC 0 | R.T.(25) | 99 TO 1 | B |
| 17 | DC | 0 | – | DC | 0 | – | RECTANGULAR | ±10 | 1 | DC20 | R.T.(25) | 132 TO 1 | B |
| 18 | DC | 0 | – | DC | 0 | – | RECTANGULAR | ±10 | 200 | DC20 | R.T.(25) | 88 TO 1 | B |
| 19 | DC | 0 | – | DC | 0 | – | TRIANGULAR | ±10 | 60 | DC20 | R.T.(25) | 99 TO 1 | B |
| 20 | DC | 0 | – | DC | 0 | – | SINUSOIDAL | ±10 | 60 | DC20 | R.T.(25) | 99 TO 1 | B |

R. T. : ROOM TEMPERATURE

FIG. 12

| SAMPLE NO. | Vcs | | | Vsig | | | Vcom | | | Vg | PANEL | CONTRAST | IMAGE |
|---|---|---|---|---|---|---|---|---|---|---|---|---|---|
| | WAVEFORM | VOLTAGE (V) | FREQUENCY (Hz) | WAVEFORM | VOLTAGE (V) | FREQUENCY (Hz) | WAVEFORM | VOLTAGE (V) | FREQUENCY (Hz) | VOLTAGE (V) | TEMPERATURE (°C) | | QUALITY |
| 11-2 | DC | 0 | - | DC | 0 | - | RECTANGULAR | ±5 | 60 | DC20 | 50→R.T.(25) | 110 TO 1 | B |
| 12-2 | DC | 0 | - | DC | 0 | - | RECTANGULAR | ±10 | 60 | DC20 | 50→R.T.(25) | 165 TO 1 | B |
| 13-2 | DC | 0 | - | DC | 0 | - | RECTANGULAR | ±15 | 60 | DC20 | 50→R.T.(25) | 220 TO 1 | A |
| 14-2 | RECTANGULAR | ±3.5 | 60 | RECTANGULAR | ±2.5 | 60 | RECTANGULAR | ±7.5 | 60 | DC20 | 50→R.T.(25) | 165 TO 1 | B |
| 15-2 | DC | 0 | - | FLOATING | | - | RECTANGULAR | ±10 | 60 | DC 0 | 50→R.T.(25) | 154 TO 1 | A |
| 16-2 | RECTANGULAR | ±3.5 | 60 | FLOATING | | - | RECTANGULAR | ±7.5 | 60 | DC 0 | 50→R.T.(25) | 149 TO 1 | A |
| 17-2 | DC | 0 | - | DC | 0 | - | RECTANGULAR | ±10 | 1 | DC20 | 50→R.T.(25) | 198 TO 1 | A |
| 18-2 | DC | 0 | - | DC | 0 | - | RECTANGULAR | ±10 | 200 | DC20 | 50→R.T.(25) | 110 TO 1 | B |
| 19-2 | DC | 0 | - | DC | 0 | - | TRIANGULAR | ±10 | 60 | DC20 | 50→R.T.(25) | 132 TO 1 | B |
| 20-2 | DC | 0 | - | DC | 0 | - | SINUSOIDAL | ±10 | 60 | DC20 | 50→R.T.(25) | 132 TO 1 | B |

→ : TRANSITION TIME (10MIN)
R. T. : ROOM TEMPERATURE

FIG. 13

| SAMPLE NO. | Vcs | | | Vsig | | | Vcom | | | Vg | PANEL TEMPERATURE (°C) | CONTRAST | IMAGE QUALITY |
|---|---|---|---|---|---|---|---|---|---|---|---|---|---|
| | WAVEFORM | VOLTAGE (V) | FREQUENCY (Hz) | WAVEFORM | VOLTAGE (V) | FREQUENCY (Hz) | WAVEFORM | VOLTAGE (V) | FREQUENCY (Hz) | VOLTAGE (V) | | | |
| 11-3 | DC | 0 | - | DC | 0 | - | RECTANGULAR | ±5 | 60 | DC20 | 90→R.T.(25) | 220 TO 1 | A |
| 12-3 | DC | 0 | - | DC | 0 | - | RECTANGULAR | ±10 | 60 | DC20 | 90→R.T.(25) | 220 TO 1 | A |
| 13-3 | DC | 0 | - | DC | 0 | - | RECTANGULAR | ±15 | 60 | DC20 | 90→R.T.(25) | 220 TO 1 | A |
| 14-3 | RECTANGULAR | ±3.5 | 60 | RECTANGULAR | ±2.5 | 60 | RECTANGULAR | ±7.5 | 60 | DC20 | 90→R.T.(25) | 220 TO 1 | A |
| 15-3 | DC | 0 | - | FLOATING | | - | RECTANGULAR | ±10 | 60 | DC 0 | 90→R.T.(25) | 220 TO 1 | A |
| 16-3 | RECTANGULAR | ±3.5 | 60 | FLOATING | | - | RECTANGULAR | ±7.5 | 60 | DC 0 | 90→R.T.(25) | 220 TO 1 | A |
| 17-3 | DC | 0 | - | DC | 0 | - | RECTANGULAR | ±10 | 1 | DC20 | 90→R.T.(25) | 220 TO 1 | A |
| 18-3 | DC | 0 | - | DC | 0 | - | RECTANGULAR | ±10 | 200 | DC20 | 90→R.T.(25) | 220 TO 1 | A |
| 19-3 | DC | 0 | - | DC | 0 | - | TRIANGULAR | ±10 | 60 | DC20 | 90→R.T.(25) | 220 TO 1 | A |
| 20-3 | DC | 0 | - | DC | 0 | - | SINUSOIDAL | ±10 | 60 | DC20 | 90→R.T.(25) | 220 TO 1 | A |

→ : TRANSITION TIME (20MIN)
R. T. : ROOM TEMPERATURE

FIG. 14

| SAMPLE NO. | Vcs | | | Vsig | | | Vcom | | | Vg | PANEL TEMPERATURE (°C) | CONTRAST | IMAGE QUALITY |
|---|---|---|---|---|---|---|---|---|---|---|---|---|---|
| | WAVEFORM | VOLTAGE (V) | REQUENC (Hz) | WAVEFORM | VOLTAGE (V) | FREQUENCY (Hz) | WAVEFORM | VOLTAGE (V) | FREQUENCY (Hz) | VOLTAGE (V) | | | |
| C11 | DC | 0 | - | RECTANGULAR | ±2.5 | 60 | DC | 0 | - | LAATSP Vgh=20 | R.T.(25) | 5 TO 1 | E |
| C12 | DC | 0 | - | RECTANGULAR | ±5.0 | 60 | DC | 0 | - | LAATSP Vgh=25 | R.T.(25) | 50 TO 1 | D |
| C13 | RECTANGULAR | ±2.5 | 60 | RECTANGULAR | ±2.5 | 60 | RECTANGULAR | ±2.5 | 60 | LAATSP Vgh=20 | R.T.(25) | 50 TO 1 | D |
| C14 | DC | 0 | - | RECTANGULAR | ±2.5 | 60 | DC | 0 | - | LAATSP Vgh=20 | 50→R.T.(25) | 10 TO 1 | E |
| C15 | DC | 0 | - | RECTANGULAR | ±5.0 | 60 | DC | 0 | - | LAATSP Vgh=25 | 50→R.T.(25) | 60 TO 1 | D |
| C16 | RECTANGULAR | ±2.5 | 60 | RECTANGULAR | ±2.5 | 60 | RECTANGULAR | ±2.5 | 60 | LAATSP Vgh=20 | 50→R.T.(25) | 60 TO 1 | D |
| C17 | DC | 0 | - | RECTANGULAR | ±2.5 | 60 | DC | 0 | - | LAATSP Vgh=20 | 90→R.T.(25) | 20 TO 1 | D |
| C18 | DC | 0 | - | RECTANGULAR | ±5.0 | 60 | DC | 0 | - | LAATSP Vgh=25 | 90→R.T.(25) | 70 TO 1 | D |
| C19 | RECTANGULAR | ±2.5 | 60 | RECTANGULAR | ±2.5 | 60 | RECTANGULAR | ±2.5 | 60 | LAATSP Vgh=20 | 90→R.T.(25) | 70 TO 1 | D |

LAATSP : LINE-AT-A-TIME SCANNING PULSE
→ : TRANSITION TIME (10MIN)
R.T. : ROOM TEMPERATURE

FIG. 15

| SAMPLE NO. | Vcs | | | Vsig | | | Vcom | | | Vg | PANEL TEMPERATURE | CONTRAST | IMAGE QUALITY |
|---|---|---|---|---|---|---|---|---|---|---|---|---|---|
| | WAVEFORM | VOLTAGE (V) | FREQUENCY (Hz) | WAVEFORM | VOLTAGE (V) | FREQUENCY (Hz) | WAVEFORM | VOLTAGE (V) | FREQUENCY (Hz) | VOLTAGE (V) | (℃) | | |
| 21 | RECTANGULAR | ±5 | 60 | FLOATING | | - | DC | 0 | - | FLOATING | R.T.(25) | 77 TO 1 | C |
| 22 | RECTANGULAR | ±10 | 60 | FLOATING | | - | DC | 0 | - | FLOATING | R.T.(25) | 110 TO 1 | B |
| 23 | RECTANGULAR | ±15 | 60 | FLOATING | | - | DC | 0 | - | FLOATING | R.T.(25) | 220 TO 1 | A |
| 24 | RECTANGULAR | ±7.5 | 60 | FLOATING | | - | RECTANGULAR | ±2.5 | 60 | FLOATING | R.T.(25) | 110 TO 1 | B |
| 25 | RECTANGULAR | ±10 | 60 | FLOATING | | - | DC | 0 | - | DC 0 | R.T.(25) | 105 TO 1 | B |
| 26 | RECTANGULAR | ±7.5 | 60 | RECTANGULAR | ±6.5 | 60 | RECTANGULAR | ±2.5 | 60 | DC20 | R.T.(25) | 99 TO 1 | B |
| 27 | RECTANGULAR | ±10 | 1 | FLOATING | | - | DC | 0 | - | FLOATING | R.T.(25) | 132 TO 1 | B |
| 28 | RECTANGULAR | ±10 | 200 | FLOATING | | - | DC | 0 | - | FLOATING | R.T.(25) | 88 TO 1 | B |
| 29 | TRIANGULAR | ±10 | 60 | FLOATING | | - | DC | 0 | - | FLOATING | R.T.(25) | 99 TO 1 | B |
| 30 | SINUSOIDAL | ±10 | 60 | FLOATING | | - | DC | 0 | - | FLOATING | R.T.(25) | 99 TO 1 | B |

R. T. : ROOM TEMPERATURE

FIG. 16

| SAMPLE NO. | Vcs | | | Vsig | | | Vcom | | | Vg | PANEL | CONTRAST | IMAGE |
|---|---|---|---|---|---|---|---|---|---|---|---|---|---|
| | WAVEFORM | VOLTAGE (V) | FREQUENCY (Hz) | WAVEFORM | VOLTAGE (V) | FREQUENCY (Hz) | WAVEFORM | VOLTAGE (V) | FREQUENCY (Hz) | VOLTAGE (V) | TEMPERATURE (°C) | | QUALITY |
| 21-2 | RECTANGULAR | ±5 | 60 | FLOATING | | - | DC | 0 | - | FLOATING | 50→R.T.(25) | 77 TO 1 | C |
| 22-2 | RECTANGULAR | ±10 | 60 | FLOATING | | - | DC | 0 | - | FLOATING | 50→R.T.(25) | 110 TO 1 | B |
| 23-2 | RECTANGULAR | ±15 | 60 | FLOATING | | - | DC | 0 | - | FLOATING | 50→R.T.(25) | 220 TO 1 | A |
| 24-2 | RECTANGULAR | ±7.5 | 60 | FLOATING | | - | RECTANGULAR | ±2.5 | 60 | FLOATING | 50→R.T.(25) | 110 TO 1 | B |
| 25-2 | RECTANGULAR | ±10 | 60 | FLOATING | | - | DC | 0 | - | DC 0 | 50→R.T.(25) | 105 TO 1 | B |
| 26-2 | RECTANGULAR | ±7.5 | 60 | RECTANGULAR | ±6.5 | 60 | RECTANGULAR | ±2.5 | 60 | DC20 | 50→R.T.(25) | 99 TO 1 | B |
| 27-2 | RECTANGULAR | ±10 | 1 | FLOATING | | - | DC | 0 | - | FLOATING | 50→R.T.(25) | 132 TO 1 | B |
| 28-2 | RECTANGULAR | ±10 | 200 | FLOATING | | - | DC | 0 | - | FLOATING | 50→R.T.(25) | 88 TO 1 | B |
| 29-2 | TRIANGULAR | ±10 | 60 | FLOATING | | - | DC | 0 | - | FLOATING | 50→R.T.(25) | 99 TO 1 | B |
| 30-2 | SINUSOIDAL | ±10 | 60 | FLOATING | | - | DC | 0 | - | FLOATING | 50→R.T.(25) | 99 TO 1 | B |

R. T. : ROOM TEMPERATURE
→ : TRANSITION TIME (10MIN)

FIG. 17

| SAMPLE NO. | Vcs | | | Vsig | | | Vcom | | | Vg | PANEL TEMPERATURE (°C) | CONTRAST | IMAGE QUALITY |
|---|---|---|---|---|---|---|---|---|---|---|---|---|---|
| | WAVEFORM | VOLTAGE (V) | FREQUENCY (Hz) | WAVEFORM | VOLTAGE (V) | FREQUENCY (Hz) | WAVEFORM | VOLTAGE (V) | FREQUENCY (Hz) | VOLTAGE (V) | | | |
| 21-3 | RECTANGULAR | ±5 | 60 | FLOATING | | - | DC | 0 | - | FLOATING | 90→R.T.(25) | 220 TO 1 | A |
| 22-3 | RECTANGULAR | ±10 | 60 | FLOATING | | - | DC | 0 | - | FLOATING | 90→R.T.(25) | 220 TO 1 | A |
| 23-3 | RECTANGULAR | ±15 | 60 | FLOATING | | - | DC | 0 | - | FLOATING | 90→R.T.(25) | 220 TO 1 | A |
| 24-3 | RECTANGULAR | ±7.5 | 60 | FLOATING | | - | RECTANGULAR | ±2.5 | 60 | FLOATING | 90→R.T.(25) | 220 TO 1 | A |
| 25-3 | RECTANGULAR | ±10 | 60 | FLOATING | | - | DC | 0 | - | DC 0 | 90→R.T.(25) | 220 TO 1 | A |
| 26-3 | RECTANGULAR | ±7.5 | 60 | RECTANGULAR | ±6.5 | 60 | RECTANGULAR | ±2.5 | 60 | DC20 | 90→R.T.(25) | 220 TO 1 | A |
| 27-3 | RECTANGULAR | ±10 | 1 | FLOATING | | - | DC | 0 | - | FLOATING | 90→R.T.(25) | 220 TO 1 | A |
| 28-3 | RECTANGULAR | ±10 | 200 | FLOATING | | - | DC | 0 | - | FLOATING | 90→R.T.(25) | 220 TO 1 | A |
| 29-3 | TRIANGULAR | ±10 | 60 | FLOATING | | - | DC | 0 | - | FLOATING | 90→R.T.(25) | 220 TO 1 | A |
| 30-3 | SINUSOIDAL | ±10 | 60 | FLOATING | | - | DC | 0 | - | FLOATING | 90→R.T.(25) | 220 TO 1 | A |

R. T. : ROOM TEMPERATURE
→ : TRANSITION TIME (20MIN)

FIG. 18

LIQUID CRYSTAL DISPLAY DEVICE

BACKGROUND OF THE INVENTION

This invention relates to a liquid crystal display device using a liquid crystal material having spontaneous polarization induced by application of an electric field or inherent thereto.

A liquid crystal display device has a feature of low voltage consumption, light in weight and the like, and are widely used for a display device of a word processor, personal computer or car navigation system. Particularly, a TN mode TFT-LCD having pixels connected to switching elements such as TFTs (thin film transistors) and using a nematic liquid crystal has an excellent display performance. However, the TN mode has a problem that the viewing angle is narrow and the response speed is low.

At present, a liquid crystal display element constructed by a liquid crystal material (antiferroelectric liquid crystal, ferroelectric liquid crystal or the like) having spontaneous polarization induced by application of the electric field or inherent thereto and held between two electrodes has received much attention as a display element having a wide viewing angle and high response speed.

Most types of liquid crystals having spontaneous polarization take three alignment states of no voltage application state, positive voltage application state and negative voltage application state.

Recently, liquid crystal materials such as a thresholdless antiferroelectric liquid crystal (TLAF), Deformed-Helix Ferroelectric liquid crystal (DHF), Twisted Ferroelectric liquid crystal (TFLC) or electric clinic, which could take an alignment state between the above three states according to an applied voltage in addition to the above three alignment states, were found among the liquid crystal materials having spontaneous polarization. The above liquid crystal materials have no or little memory characteristic, but a desired alignment state thereof can be held and gray scale display can be attained by using switching elements such as TFTs, TFDs (thin film diodes) or MIMs (metal-insulator-metal diodes) provided for the respective pixels in the active matrix system and holding the voltage during the non-selected period. As a result, a liquid crystal display device which can display gray scales with high speed and wide viewing angle can be attained.

The arrangement of molecules of a liquid crystal having spontaneous polarization is set in a state called a smectic phase. In the smectic phase, rod-like molecules are arranged in a layered form and set in parallel to one another as shown in FIGS. 1A and 1B.

If an external force is applied to the image plane of the liquid crystal display device by depressing the image plane by a finger, for example, the alignment of the liquid crystal is disturbed and the display becomes defective. In the TN mode or STN mode, since the liquid crystal has no layer structure, the alignment is naturally restored to the original state and the defective display can be cancelled when the external force is removed.

However, since the order parameter of the liquid crystal of the smectic phase is high, the disturbed layer structure cannot be restored even when the external force is removed if the alignment is once destroyed by application of the external force or the like. That is, the alignment of the liquid crystal is not restored to the original state and a portion to which the external force is applied remains semi-permanently as a display defective portion.

For example, in the case of antiferroelectric liquid crystal, if a force of 2 kg/cm$^2$ or more is applied to the liquid crystal display element by a finger or the like, the layer structure of the smectic liquid crystal is disturbed as shown in FIGS. 1C and 1D and the alignment is not restored to the original state even if the force is removed, and an alignment defective region is formed.

Since the alignment degree of the liquid crystal molecules is lowered in the alignment defective region, display of black level is made poor (the transmission factor is high when black is displayed) and the contrast is lowered so that the display quality of the liquid crystal display device will be significantly degraded. Thus, the liquid crystal of smectic phase has a serious problem that the "alignment destruction" occurs by finger-pressing or the like.

In order to restore the liquid crystal alignment which is once disturbed to a uniform state (to effect the alignment treatment), the following methods are provided.

(1) After the temperature of the liquid crystal is raised to a temperature of phase transfer to the isotropic phase or more, or a temperature approximately equal thereto, the temperature is gradually cooled to the room temperature.

(2) A relatively high AC voltage (generally, ±7V or more, preferably, ±10V or more is applied between the pixel electrode and the common electrode) which is approximately equal to the saturation voltage is applied to the liquid crystal (this method is also called a voltage application alignment treatment).

(3) A combination of the methods (1) and (2) is effected.

In the method (1), the liquid crystal display device can be carried into a electronic oven or the like and the liquid crystal can be easily heated to the phase-transfer temperature if the circuit is not yet mounted. However, if the TAB and driving circuit are mounted on the liquid crystal display device, the plastic-made casing and polarization plate are deformed or deteriorated when the whole portion of the liquid crystal display device is heated in the electronic oven and thus it is extremely difficult to heat the liquid crystal to the phase transfer temperature without giving any influence on other members.

Further, the method (1) is effective only when the liquid crystal molecules exhibit the nematic phase at a temperature higher than that for the smectic C-phase as in a certain type of DHF. However, the method is not effective when the liquid crystal makes phase transfer from the isotropic phase to the smectic phase without passing through the nematic phase as in the case of thresholdless antiferroelectric liquid crystal.

In the method (2), it is possible to apply a sufficiently high voltage by use of a function generator and amplifier if the driving circuit is not yet mounted on the liquid crystal display device. However, the inventors of the present invention studied this method and found that the following problems would occur if this method was applied to the liquid crystal display device having switching elements such as TFTs.

It is necessary to apply a voltage higher than the pixel voltage by approximately 15V or more in order to turn ON the TFT element. Therefore, in order to apply a high voltage to the pixel electrode and effect the alignment treatment, it is necessary to apply a gate voltage which is higher than usual. However, if the high voltage is applied to the gate, a problem that the reliability of the TFT element is lowered due to degradation of the insulating property of the gate insulating film has occurred.

Further, the characteristics of switching elements provided for the respective pixels slightly fluctuate and the fluctuation of the characteristic becomes significant when a voltage of ±5V or more is applied to the pixel electrode. When the voltage of ±5V or more is applied to the pixel electrode to effect the alignment treatment, the effective values of the applied voltages are slightly different depending on the respective pixels and the degree of the alignment treatment becomes different for each pixel, thereby making the display state worse.

If the TAB and driving circuit are mounted on the liquid crystal display device, only a maximum voltage of ±5V, can be applied to the pixel electrode, since the maximum amplitude of a withstand voltage of the normal driver IC is 5V, or the maximum amplitude is 10V when a special driver IC is used. Therefore, a problem that a high voltage (±7V or more) necessary for the alignment treatment cannot be applied to the pixel electrode occurs.

Further, in a case wherein the gates are driven based on the line-at-a-time scanning method, the write time (in which one TFT is kept ON) is different depending on the definition of the image plane but is 10 to 70 $\mu$s. If the response time of the liquid crystal is longer than the write time, the electric field response of the liquid crystal is not completed in the write period of time and the liquid crystal tends to make a response by consuming charges stored on the storage capacitor, so that the holding rate will be lowered and the effective voltage applied to the liquid crystal will be lowered. As a result, there occurs a problem that the sufficient alignment treatment cannot be effected for the liquid crystal.

BRIEF SUMMARY OF THE INVENTION

An object of this invention is to provide a liquid crystal display device which can easily restore the liquid crystal alignment, even if the driving circuit and the like are mounted, and can always display an image of high contrast and good quality.

In order to attain the above object, a liquid crystal display device according to a first aspect of this invention comprises a first base plate; a plurality of pixel electrodes arranged in rows and columns on the first base plate; a plurality of switching transistors formed in correspondence to the plurality of pixel electrodes, each of the plurality of switching transistors having a gate electrode and a source and a drain region and one of the source and the drain region being connected to a corresponding one of the plurality of pixel electrodes; a plurality of scanning lines arranged on the rows of the first base plate, each of the plurality of scanning lines being connected to the gate electrode of a corresponding one of the plurality of switching transistors; a plurality of signal lines arranged on the columns of the first base plate, each of the plurality of signal lines being connected to the other of the source and the drain region of the corresponding one of the plurality of switching transistors; a second base plate arranged in opposition to a surface of the first base plate on which the plurality of pixel electrodes are formed; a common electrode arranged on the second base plate; a liquid crystal material sealed between the first and the second base plate and having spontaneous polarization; driving means for simultaneously selecting and driving a desired number of scanning lines among the plurality of scanning lines; and voltage applying means for applying a desired voltage to the common electrode.

It is preferable that the desired number of scanning lines are adjacent to one another and arranged side by side.

Further, it is preferable to set the desired number of scanning lines to 10 or more.

It is effective to use the scanning lines passing anyone of a portion in which the alignment of the liquid crystal material is disturbed and a portion in which image sticking is generated as the desired number of scanning lines.

The voltage applying means has an operation mode for applying the desired voltage in a non-display period.

The non-display period can be set as a period in which display is suspended for the sake of energy saving.

The voltage applying means applies a voltage for correcting anyone of alignment and image sticking of the liquid crystal material.

The voltage applying means can apply a signal voltage higher than a maximum value of a signal voltage, which is applied to the plurality of pixel electrodes, to the common electrode.

The voltage applying means can apply a voltage having a phase difference of 180° with respect to a signal applied to a corresponding one of the plurality of pixels to the common electrode.

It is preferable to further comprise means for heating the liquid crystal material.

The heating means can contain the common electrode.

It is preferable to further comprise an external switching circuit for turning ON/OFF the driving means and the voltage applying means.

There is further provided writing means for writing positional information on a display image plane according to a mechanical stress applied from a surface of the second base plate which is farther away from the first base plate, and when the mechanical stress comes over a stress enough to disturb of the liquid crystal material, the writing means can generate a signal for operating the driving means and the voltage applying means.

According to this invention, ON signals are supplied to a plurality of scanning lines to turn ON the switching transistors connected to the scanning lines and a voltage is applied to the common electrode so as to restore the liquid crystal alignment even after the driving circuit and the like are mounted.

Further, by selecting a plurality of scanning lines, a sufficiently strong electric field can be stably and uniformly applied to liquid crystal molecules between the pixel electrode and the common electrode, thereby making it possible to easily restore the liquid crystal alignment.

A liquid crystal display device according to a second aspect of this invention comprises a first base plate; a storage capacitor electrode formed on the first base plate; an insulating film formed above the first base plate with the storage capacitor electrode disposed therebetween; a plurality of pixel electrodes arranged in rows and columns on the insulating film; a plurality of switching transistors formed in correspondence to the plurality of pixel electrodes on the insulating film, each of the plurality of switching transistors having a gate electrode and a source and a drain region and one of the source and the drain region being connected to a corresponding one of the plurality of pixel electrodes; a plurality of scanning lines arranged on the rows of the first base plate, each of the plurality of scanning lines being connected to the gate electrode of a corresponding one of the plurality of switching transistors; a plurality of signal lines arranged on the columns of the first base plate, each of the plurality of signal lines being connected to the other of the source and the drain region of the corresponding one of the plurality of switching transistors; a second base plate arranged in opposition to a surface of the first base plate on which the plurality of pixel electrodes are formed; a common electrode formed on the second base plate; a liquid crystal material sealed between the first and the second base plate and having spontaneous polarization; and voltage applying means for applying a desired voltage between the common electrode and the storage capacitor electrode.

It is preferable to further comprise means for simultaneously selecting and driving a desired number of scanning lines among the plurality of scanning lines.

The liquid crystal display device has an operation mode for setting a potential of the plurality of pixel electrodes into an electrically floating state when the voltage applying means applies the desired voltage between the common electrode and the storage capacitor electrode.

It is preferable that the display device further comprises a black matrix formed in correspondence to spaces between the plurality of pixel electrodes, and the storage capacitor electrode contains a portion formed in a region which faces the black matrix.

The voltage applying means applies the desired voltage in a non-display period.

The non-display period contains a period in which display is suspended for the sake of energy saving.

The voltage applying means can apply a voltage for correcting anyone of alignment and image sticking of the liquid crystal material.

The voltage applying means can apply a signal voltage higher than a maximum value of a voltage, which is applied to the plurality of pixel electrode, between the common electrode and the storage capacitor electrode.

It is preferable to further comprise means for heating the liquid crystal material.

The heating means can contain at least one of the storage capacitor electrode and the common electrode.

It is preferable to further comprise an external switching circuit for turning ON/OFF the voltage applying means.

In the first aspect of this invention, the alignment treatment by voltage application is effected by generating an electric field between the pixel electrode and the common electrode. Therefore, with the construction of the first aspect, the alignment treatment for the liquid crystal molecules on a region in which no pixel electrode is formed (that is, on the surrounding portion of the pixel electrode) cannot be effected. In order to prevent transmission of light through the non-pixel region, it becomes necessary to conceal the non-pixel region with a black matrix or the like. At the time of assembling the cell, since a margin of several $\mu$m for alignment between the first base plate having pixel electrodes formed thereon and the second base plate having the black matrix formed thereon is required, it is necessary to make the black matrix thick and conceal part of the pixel electrodes by taking the alignment margin into consideration. As a result, the opening ratio is lowered. Further, when the alignment of the liquid crystal in the surrounding portion of the pixel is extremely low, the degree of the alignment of the liquid crystal of the pixel portion is influenced by the surrounding portion and is also lowered, thereby degrading the contrast.

Therefore, in the second aspect, means for applying a voltage between the common electrode and the storage capacitor electrode is provided to stably and uniformly apply a sufficiently strong electric field to liquid crystal molecules in the non-pixel region, thereby making it possible to restore the liquid crystal alignment.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinbefore.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

FIG. 1A shows a display image plane of a liquid crystal display device;

FIG. 1B is an enlarged view of a portion 1B in FIG. 1A and shows the layer structure of smectic liquid crystal molecules;

FIG. 1C is a view schematically showing a finger-pressed portion on the liquid crystal image plane;

FIG. 1D is an enlarged view of a portion 1D in FIG. 1C and shows disturbance of the layer structure;

FIG. 2 is a block diagram showing the construction of a liquid crystal display device according to a first embodiment of this invention;

FIG. 5 is a diagram showing the alignment treatment conditions and alignment treatment results of evaluation samples according to the first embodiment;

FIG. 6 is a diagram showing the alignment treatment conditions and alignment treatment results of other evaluation samples according to the first embodiment;

FIG. 7 is a diagram showing the alignment treatment conditions and alignment treatment results of still other evaluation samples according to the first embodiment;

FIG. 8 is a diagram showing the alignment treatment conditions and alignment treatment results of comparison samples using the conventional method;

FIG. 12 is a diagram showing the alignment treatment conditions and alignment treatment results of evaluation samples according to the second embodiment;

FIG. 13 is a diagram showing the alignment treatment conditions and alignment treatment results of other evaluation samples according to the second embodiment;

FIG. 14 is a diagram showing the alignment treatment conditions and alignment treatment results of still other evaluation samples according to the second embodiment;

FIG. 15 is a diagram showing the alignment treatment conditions and alignment treatment results of comparison samples using the conventional method;

FIG. 16 is a diagram showing the alignment treatment conditions and alignment treatment results of other evaluation samples according to the second embodiment;

FIG. 17 is a diagram showing the alignment treatment conditions and alignment treatment results of still other evaluation samples according to the second embodiment; and FIG. 18 is a diagram showing the alignment treatment conditions and alignment treatment results of still other evaluation samples according to the second embodiment.

DETAILED DESCRIPTION OF THE INVENTION

Figure 3A:
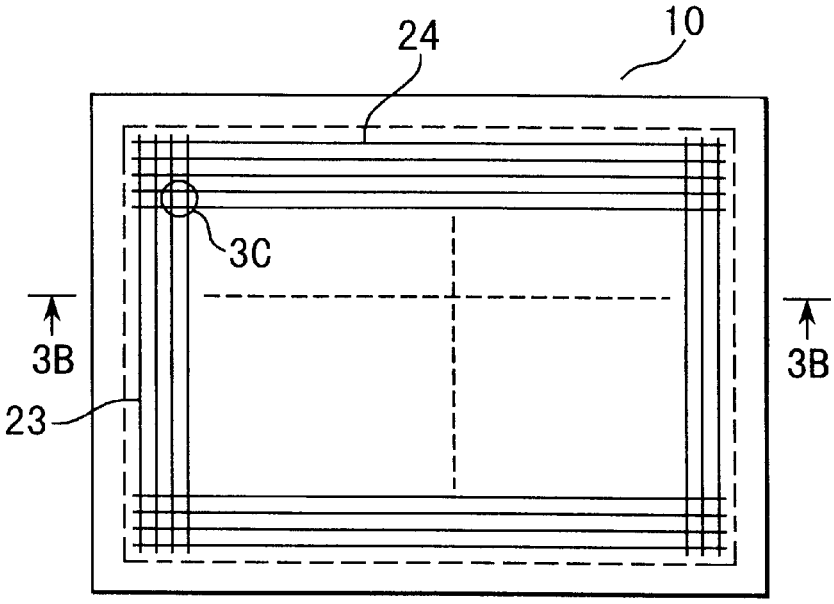
FIG. 3A is a schematic plan view of the liquid crystal display device according to the first embodiment.

There will now be described embodiments of this invention with reference to the accompanying drawings.

[First Embodiment]

FIG. 2 is a block diagram showing the construction of a liquid crystal display device according to a first embodiment of this invention.

The liquid crystal display device of this invention has a structure obtained by adding a common electrode driver 35, alignment controller 36, heater controller 37 and sheet-like heater 38 to the structure of the conventional active matrix type liquid crystal display device. It is possible to connect the heater controller 37 to the common electrode and use the common electrode as a heater instead of the sheet-like heater 38.

That is, in the structure of the liquid crystal display device of this embodiment, a display signal 31 and sync signal 32 are supplied to a display timing controller 30. The display timing controller 30 is connected to a liquid crystal display element 10 via a signal line driver 33, scanning line driver 34 and common electrode driver 35 in parallel.

Further, the display timing controller 30 is connected to the alignment controller 36. The alignment controller 36 is connected to the sheet-like heater 38 via the heater controller 37. The sheet-like heater 38 is attached to the surface of the liquid crystal display element 10.

Figure 3B:
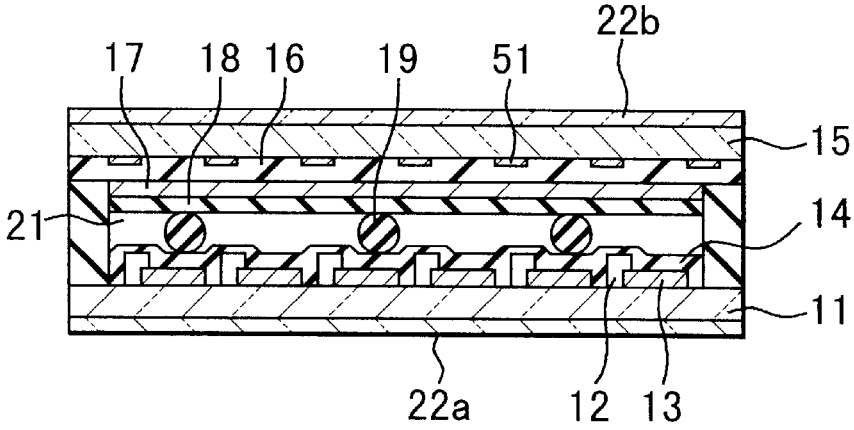
FIG. 3B is a cross sectional view taken along the line 3B—3B in FIG. 3A.
Figure 3C:
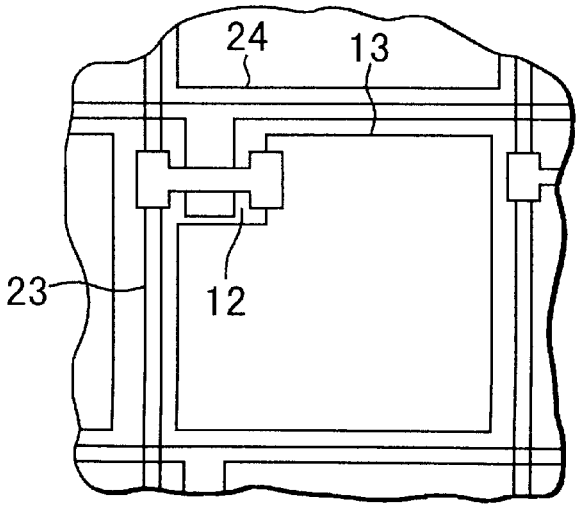
FIG. 3C is an enlarged view of a portion 3C in FIG. 3A.

FIGS. 3A to 3C show the structure of the liquid crystal display element 10 shown in FIG. 2. FIG. 3A is a plan view of the liquid crystal display element 10, FIG. 3B is a cross sectional view thereof, and FIG. 3C is a schematic plan view of one pixel.

Switching elements 12 such as TFTs are arranged in a matrix form on a first glass base plate 11. Further, pixel electrodes 13 formed of a transparent conductive film of ITO (Indium Tin Oxide), for example, and connected to the switching elements 12 are formed on the first glass base plate 11. An alignment film 14 formed of polyimide resin or the like is formed on the entire surface.

A second glass base plate 15 is arranged in opposition to the pixel electrodes 13 on the first glass base plate 11. A black matrix 51 arranged in correspondence to spaces between the pixel electrodes to prevent undesirable transmission of light and a color filter 16 arranged in correspondence to the pixel electrodes are formed on the surface of the second glass base plate 15 which faces the pixel electrodes 13. A common electrode 17 formed of a transparent conductive film of ITO or the like is formed on the color filter 16. An alignment film 18 formed of polyimide resin or the like is formed on the common electrode 17. The two structures are held by spacers 19 scattered on the alignment film 14 and a liquid crystal 21 such as a ferroelectric liquid crystal (FLC), antiferroelectric liquid crystal (AFLC), TLAF, DHF or twisted FLC having spontaneous polarization induced by application of an electric field or inherent thereto is inserted between the two structures.

Further, polarizing plates 22*a* and 22*b* are attached to the outside surfaces of the first and second glass base plates 11 and 15.

A reference numeral 23 shown in FIGS. 3A and 3C denotes signal lines, 24 denotes gate (scanning) lines and Cs (storage capacitor) lines are omitted in the drawing.

The undesirable transmission of light occurs in the following case. When a DC component is applied to the liquid crystal, ionic impurities in the liquid crystal are absorbed in the interface between the liquid crystal and the alignment film. According to an electric field formed by the ionic impurities, a local electric field is applied to the liquid crystal, thereby to make the alignment of the liquid crystal un-uniform with a result of the undesirable transmission of light.

The alignment treatment becomes necessary, when alignment of the liquid crystal is destroyed by application of external force to the liquid crystal display device 10, when the liquid crystal display device 10 is exposed to the high temperature and the uniformity of the liquid crystal alignment is lowered, when the same image is displayed for a long time and the image sticking occurs, or when the alignment is disturbed or the layer rotation is generated due to application of DC bias (component) to the liquid crystal for a long period of time.

Figure 4A:
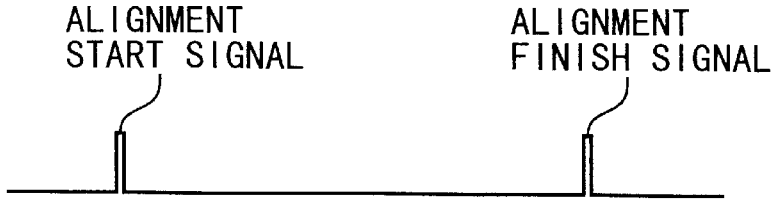
FIGS. 4A to 4F are timing charts of various signals according to the first embodiment;.

An external switch 39 for starting/terminating the alignment treatment is provided in the liquid crystal display device 10 so that the alignment treatment can be started according to the determination of the user. When the user depresses the external switch, an alignment start signal is output (FIG. 4A) from the alignment controller 36 and the alignment treatment for the liquid crystal is effected.

When the alignment start signal is output from the alignment controller 36, the display timing controller 30 issues an instruction to the scanning driver 32 so as to select a plurality of scanning lines corresponding to the whole portion or a portion in which the alignment is required. Then, it instructs the common electrode driver 35 and signal line driver 33 to output voltages for restoring the alignment of the liquid crystal molecules.

At the time of alignment treatment, a voltage effectively applied to the liquid crystal molecules is a voltage sufficiently high to restore the alignment. However, the voltage applied to the signal line is a signal of a level approximately equal to that used at the time of normal image display and it is made unnecessary to use a special signal line driver.

In some cases, an instruction is output from the alignment controller 36 to the heater controller 37 to turn ON the heater 38 and warm the liquid crystal display element 10. Then, the display controller 30 terminates the alignment treatment when the alignment termination signal is output (FIG. 4A) from the alignment controller 36.

Further, it is possible to output the alignment start signal from the alignment controller 36 at a specified timing, for example, immediately after the liquid crystal display device is turned ON, or when the liquid crystal display device is turned OFF or when a preset period of time has elapsed.

A portable computer or the like has an "energy-saving mechanism" which starts the screen saver or automatically turns OFF the back light when detecting that no input is made to the keyboard for a preset period of time. When the liquid crystal display device is used as a terminal device of the computer or the like, an alignment start signal can also be output from the alignment controller 36 in cooperation with the energy-saving mechanism while the energy-saving mechanism is activated (this period is also contained in the non-display period).

A method for forming the liquid crystal display device 10 of this embodiment is explained.

Thin films of soluble polyimide (AL-1051 made by Japan Synthetic Rubber Co. Ltd) are offset-printed on the first glass base plate 11 on which the switching elements 12 and pixel electrodes 13 are formed in the matrix form and the second base plate on which the color filter 16 and black matrix are formed. Then, the thus obtained structure is heated at 90° C. for 3 minutes by use of a hot plate and baked at 180° C. for 30 minutes in an $N_2$ atmosphere to form alignment films 14, 18.

The thus formed polyimide alignment films (film thickness 65 nm) are subjected to the rubbing process. The rubbing directions of the first glass base plate 11 and the second glass base plate 15 are made antiparallel and the cross rubbing angle is set to 5°.

Next, spacer particles (diameter 2 $\mu$m) 19 are scattered on the first glass base plate 11. A ultraviolet ray curable sealant is printed on the surrounding portion of the second glass base plate 15. The first glass base plate 11 and the second glass base plate 15 are set to face each other and combined and the sealant is cured by application of ultraviolet rays under the pressed condition. After this, it is heated at 160° C. for one hour to form the liquid crystal display device 10.

The cell is carried into a vacuum chamber and heated at 120° C. and an antiferroelectric liquid crystal composite material (phase series:solid phase →−30° C. →smectic C phase→80° C. smectic A phase →85° C.→isotopic phase; response time =80 $\mu$s) transferred to the isotropic phase is injected under the vacuum condition via the injection port. After this, the injection port is sealed by use of epoxy-based adhesive. The cell gap is 2.0 $\mu$m.

Then, the transmission axis of one of the polarizing plates is set to substantially parallel to the rubbing direction and the transmission axis of the other polarizing plate is set to substantially perpendicular to the rubbing direction, and the polarizing plates are attached to the base plates. Thus, a liquid crystal display element which is 15 inches wide across corners is formed. The circuit group shown in FIG. 2 is mounted on the liquid crystal display element and inserted into a casing with back light to complete a liquid crystal display device.

In order to exhibit the effect of the alignment treatment in this invention, the alignment treatment was effected by inputting signals shown in FIGS. 4A to 4F from the driving circuit group to the liquid crystal display element after intentionally disturbing the liquid crystal alignment of the liquid crystal display element formed by the above method. In FIGS. 4A to 4F, Vsig denotes a signal applied to the signal line, Vcom denotes a signal applied to the common electrode and Vg denotes a signal applied to the scanning line.

The liquid crystal alignment is intentionally disturbed by the following method.

(1) The liquid crystal display element is heated at 100° C. for 10 minutes and then returned to the room temperature for 20 minutes to disturb the liquid crystal alignment.

(2) A force of 2 kg/cm$^2$ is applied to the central portion of the display section on a circle with the diameter of 1 cm by use of a push-pull gage to artificially cause a defect by finger-pressing.

The alignment treatment conditions and alignment treatment results (image qualities) are shown in FIGS. 5 to 7 and the process conditions and image qualities for the respective sample numbers are explained. The image quality is indicated by A, B, C, D and E in the order of high quality.

(Sample Numbers 1, 2, 3)

Figure 4B:
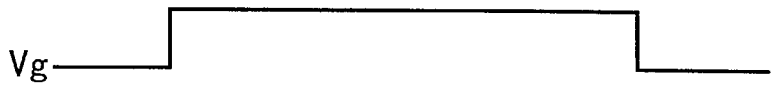
Figure 4C:
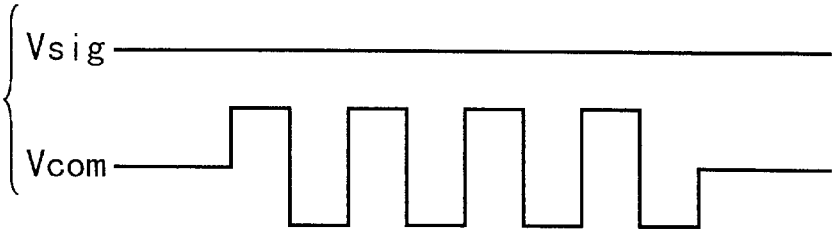

As shown in FIG. 4B, a signal Vg of DC 20V was applied to all of the scanning lines 24. This condition can be easily realized by setting all of the signals (signals of "0" or "1") supplied from the display timing controller 30 of FIG. 2 to the scanning driver 34 to "1". Thereby, as shown in FIGS. 3A to 3C, all of the switching elements 12 were normally set in the ON state.

Further, a signal Vsig of 0V was applied to the signal line 23 and the pixel electrodes 13 were held at 0V. The alignment voltages of ±5V (sample number 1), ±10V (sample number 2) or ±15V (sample number 3) of rectangular wave at 60 Hz was applied to the common electrode 17.

By applying the above voltages to the common electrode 17 to effect the alignment treatment, it became possible to apply a high voltage of ±5V or more between the pixel electrode 13 and the common electrode 17. In the conditions of the sample numbers 1 to 3, the contrasts which were 3:1 before the alignment treatment could be significantly enhanced to 70:1, 100:1 and 200:1.

Further, it became possible to uniformly apply the voltages to all of the pixels by turning ON all of the switching elements 12 and the uniform alignment treatment could be attained for the entire surface of the image plane of the liquid crystal display element. Further, by normally setting all of the switching elements 12 in the ON state, the influence by the feedthrough voltage could be eliminated.

(Sample Number 4)

Figure 4D:
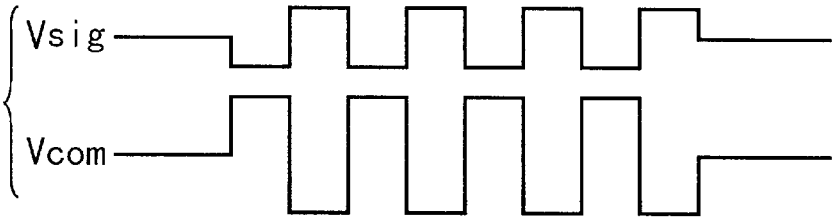

A signal Vg of DC 20V was applied to all of the scanning lines 24 (FIG. 4B) and all of the switching elements 12 were normally set in the ON state. A rectangular wave signal Vsig of ±2.5V at 60 Hz was supplied to the signal line 23 (FIG. 4D). A rectangular wave signal Vcom of ±7.5V which had a phase difference of 180° with respect to the signal applied to the signal line 23 was supplied to the common electrode 17 (FIG. 4D).

An effective voltage of ±10V could be applied between the pixel electrode 13 and the common electrode 17 like the case of the sample number 2 and the same effect could be obtained.

(Sample Number 5)

The 2-lines-at-a-time scanning operation was effected for all of the scanning lines while two adjacent scanning lines among the scanning lines 24 were being simultaneously selected. That is, a pulse wave (Vg1=−5V, Vgh=20V, period=60 Hz, write time (period in which Vgh is output)= 84 $\mu$s) shown in FIG. 4F was applied to the scanning lines 24. This condition can be easily realized by changing the signal waveform from the display timing controller 30.

In this condition, the write time became longer than the response time (80 $\mu$s) of the liquid crystal by simultaneously selecting two of the scanning lines 24. Therefore, the potential written into the pixel electrode 13 could be held in the non-selected period (in which the scanning line voltage was set at Vg1) so that the same effect as that obtained in the condition 2 could be attained.

However, in the case of the present embodiment, if the pulse wave was used as the voltage applied to the scanning lines 24, a feedthrough voltage of approximately 1V was generated. In order to solve the above problem, an offset voltage of −1V with respect to the rectangular wave signal Vcom (which is ideally set at ±10V in this case) was applied to the common electrode 17 and voltages of +9V and −11V were alternately applied at a frequency of 60 Hz.

Thus, it was confirmed that the voltages necessary for the alignment treatment could be applied and the alignment treatment could be uniformly effected for the entire surface of the image plane by simultaneously selecting a plurality of (in this example, two) scanning lines 24 even if the pulse wave was applied to the scanning lines 24.

(Sample Number 6)

All of the scanning lines which were formed adjacent to one another were divided into two groups and the half-lines-at-a-time scanning operation was alternately effected for the two groups by simultaneously selecting a plurality of scanning lines contained in each group. That is, a pulse wave (Vg1=−5V, Vgh=20V, period=60 Hz, write time (in which Vgh is output )=8.3 ms) shown in FIG. 4F was applied to the scanning lines (in this case, the duty ratio of the pulse wave shown in FIG. 4F is 50%). This condition could be easily realized by changing the signal waveform from the display timing controller 30.

In this condition, the write time became extremely longer than the response time (80 μs) of the liquid crystal by simultaneously selecting the scanning lines of a number equal to half of the whole scanning lines. Therefore, it was confirmed that the potential written into the pixel electrode could be held in the non-selected period (in which the scanning line voltage was set at Vg1) so that the same effect as that obtained in the condition 2 could be attained.

However, in the case of the present embodiment, if the pulse wave was used as the voltage applied to the scanning lines, a feedthrough voltage of 0.5V was generated. In order to solve the above problem, an offset voltage of −0.5V was added to the rectangular wave (which is ideally set at ±7.5V in this case) applied to the common electrode 17 and voltages of +7V and −8V were alternately applied at a frequency of 60 Hz.

Thus, the voltages with sufficient amplitudes for the alignment treatment could be applied and the alignment treatment could be uniformly effected for the entire surface of the image plane by simultaneously selecting a plurality of scanning lines even if the pulse wave was applied to the scanning lines 24.

(Sample Numbers 7, 8)

The conditions of the sample numbers 7 and 8 were similar to that of the sample number 2 except that the frequency of the signal Vcom supplied to the common electrode was changed to 1 Hz (Sample Number 7) or 200 Hz (Sample Number 8) and the same effects as that of the sample number 2 could be obtained. When the frequency is thus changed, it is preferable to set the signal Vcom applied to the common electrode to 0.01 Hz to 500 Hz. Particularly, in the range of 0.1 Hz to 200 Hz, the effect is significant, and more particularly, a frequency of 10 Hz to 40 Hz is preferable when taking the simplicity of formation of the circuit and time required for the alignment treatment into consideration.

(Sample Numbers 9, 10)

The conditions of the sample numbers 9 and 10 were similar to that of the sample number 2 except that the waveform of the signal Vcom supplied to the common electrode was changed to a triangular wave (Sample Number 9) or sinusoidal wave (Sample Number 10). Even if the waveform of the signal Vcom supplied to the pixel electrode was changed, substantially the same effects as that of the sample number 2 could be obtained.

(Sample Numbers 1-2 to 10-2)

The conditions of the above samples correspond to cases wherein the temperature (panel temperature) of the liquid crystal display element 10 of the sample numbers 1 to 10 is changed (FIG. 6). The panel temperature was controlled by the heater controller 37 and the sheet-like heater 38 attached to the liquid crystal display element 10.

After the panel temperature was raised to 50° C. while signals Vg, Vsig and Vcom having values shown in FIG. 6 were being supplied to the display device, it was returned to the room temperature for 10 minutes.

It was confirmed that the effect of the alignment treatment became significant in comparison with the sample numbers 1 to 10 since the motion of liquid crystal molecules became more active when the panel. temperature was raised.

(Sample Numbers 1-3 to 10-3)

The conditions for sample numbers 1-3 to 10-3 shown in FIG. 7 correspond to cases wherein the panel temperature is changed in the sample numbers 1 to 10 or 1-2 to 10-2.

After the panel temperature was raised to 90° C. while signals Vg, Vsig and Vcom having values shown in FIG. 7 were being supplied, it was returned to the room temperature for 10 minutes. That is, the liquid crystal display element was heated to a temperature higher than the phase transfer temperature of the liquid crystal and the liquid crystal material was once transferred to the isotropic phase. Therefore, since the liquid crystal alignment state set so far was reset, the effect of the alignment treatment was extremely improved.

The temperature rise to approximately 90° C. did not degrade the members of the liquid crystal display device such as the plastic-made casing or polarization plate.

Next, evaluation for comparison samples of the liquid crystal display device having the conventional structure is explained. The conditions and the like for the comparison samples are shown in FIG. 8.

(Comparison Sample C1)

Figure 4E:
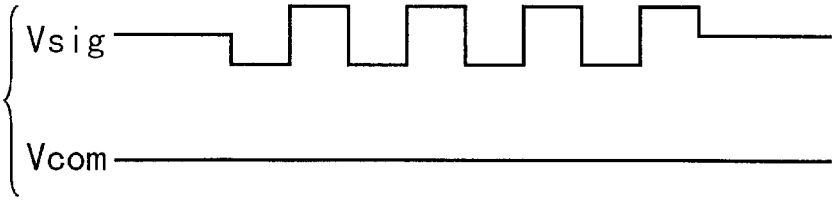
Figure 4F:
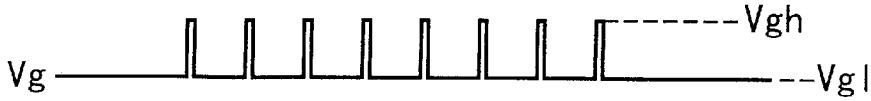

The signal Vcom supplied to the common electrode was set at a constant level and a rectangular wave signal Vsig of ±2.5V was supplied to the signal line (FIG. 4E). Since the withstand voltage of the normal signal line driver was 5V, only a maximum voltage of ±2.5V could be applied as the signal Vsig supplied to the signal line, and therefore, a satisfactory alignment treatment could not be effected.

Further, in the present comparison sample, the scanning lines were driven based on the line-at-a-time scanning method. That is, a pulse wave (Vg1=−5V, Vgh=20V, period=60 Hz, write time=42 μs) as shown in FIG. 4F was applied to the scanning lines. Since the write time was shorter than the response time (80 μs) of the liquid crystal, the potential of the pixel electrode was lowered in the non-selected period and a voltage necessary for the alignment treatment could not be applied to the liquid crystal.

Further, by the lowering in the potential of the pixel electrode (holding voltage), an influence by the delay of the gate signal became significant, the alignment treatment could not be uniformly effected and the image quality was lowered.

The influence of the delay of the gate signal is caused since the gate signal becomes dull in a portion of the display area of the liquid crystal display element which is far apart from the driver IC for supplying the gate voltage and it is a difference in the intensity of the electric field applied to the liquid crystal in a portion near the driver IC and in a portion far apart from the driver IC.

(Comparison Sample C2)

A signal Vcom supplied to the common electrode was set at a constant level and a rectangular wave signal Vsig of ±5V was supplied to the signal line (FIG. 4E). If a voltage of ±5V was applied as Vsig by use of the special signal line driver as in this example, it became necessary to raise Vgh in order to prevent a lowering in the ON-resistance of the TFT. As a result, the reliability of the TFT was lowered. Further, the image quality became irregular due to a fluctuation in the TFT characteristics.

Further, in the present comparison sample, the scanning lines were driven based on the line-at-a-time scanning method. That is, a pulse wave (Vg1=−5V, Vgh=25V, period=60 Hz, write time=42 $\mu$s) as shown in FIG. 4F was applied to the scanning line. Since the write time was shorter than the response time of the liquid crystal, the potential of the pixel electrode was lowered in the non-selected period (in which the scanning line voltage is set at Vg1) and a voltage necessary for the alignment treatment could not be applied to the liquid crystal.

Further, by the lowering in the potential of the pixel electrode, an influence by the delay of the gate signal became significant, the alignment treatment could not be uniformly effected and the image quality was lowered.

(Comparison Sample C3)

A rectangular wave signal Vsig of ±2.5V at 60 Hz was supplied to the signal line and a rectangular signal Vcom (±2.5V) having a phase difference of 180° with respect to the signal supplied to the signal line was supplied to the common electrode. Therefore, a voltage of ±5V could be written between the pixel electrode and the common electrode.

However, in the present comparison sample, the scanning lines were driven based on the line-at-a-time scanning method. That is, a pulse wave (Vg1=−5V, Vgh=20V, period=60 Hz, write time (in which Vgh is output)=42 $\mu$s) as shown in FIG. 4F was applied to the scanning line. Since the write time was shorter than the response time of the liquid crystal, the potential of the pixel electrode was lowered in the non-selected period (in which the scanning line voltage is set at Vg1) and a voltage necessary for the alignment treatment could not be applied to the liquid crystal.

Further, by the lowering in the potential of the pixel electrode, an influence by the delay of the gate signal became significant, the alignment treatment could not be uniformly effected and the image quality was lowered.

(Comparison Samples C4 to C6)

The cases of the above comparison samples correspond to cases wherein the panel temperatures of the comparison samples C1 to C3 are changed to the panel temperatures of the sample numbers 1-2 to 10-2. The contrast is improved, but the alignment treatment is irregular and the image quality is low.

(Comparison Samples C7 to C9)

The cases of the above comparison samples correspond to cases wherein the panel temperatures of the comparison samples C1 to C3 are changed to the panel temperatures of the sample numbers 1-3 to 10-3. The contrast is improved, but the alignment treatment is irregular and the image quality is low.

As described above, according to the liquid crystal display device of the present embodiment, the liquid crystal display device in which the alignment of the liquid crystal molecules can be significantly restored and the excellent display characteristic can be obtained with wide viewing angle and high response speed.

[Second Embodiment]

Figure 9:
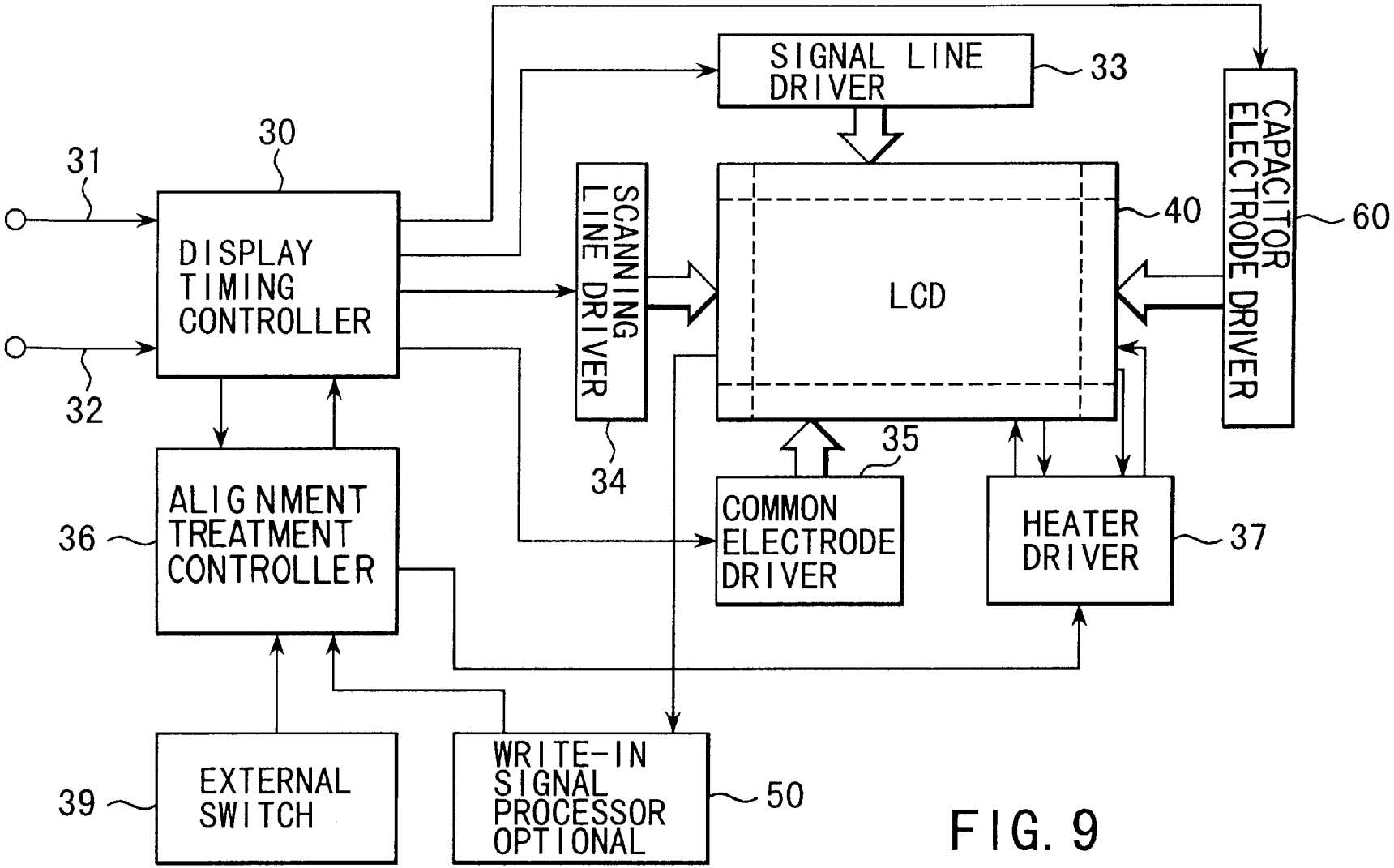
FIG. 9 is a block diagram showing the construction of a liquid crystal display device according to a second embodiment of this invention.

FIG. 9 is a block diagram showing the construction of a liquid crystal display device according to a second embodiment of this invention.

The liquid crystal display device according to the second embodiment is obtained by adding a common electrode driver 35, alignment controller 36, heater controller 37, sheet-like heater 38 and storage capacitor electrode driver 60 to the construction of the conventional active matrix type liquid crystal display device.

In the construction of the liquid crystal display device of the present embodiment, a display signal 31 and sync signal are input to a display timing controller 30. A liquid crystal display element 40 is connected to the display timing controller 30 via a signal line driver 33, scanning line driver 34 and common electrode driver 35 in parallel. Further, the alignment controller 36 and storage capacitor-electrode driver 60 are connected to the display timing controller 30.

In order to heat the liquid crystal display element 40, the heater controller 37 capable of supplying an electric power of several tens watts is connected to the common electrode or storage capacitor electrode. When the liquid crystal display element 40 is heated, a switch (not shown) between the common electrode and the common electrode driver 35 is turned OFF or a switch (not shown) between the storage capacitor electrode and the storage capacitor electrode driver is turned OFF, and a current is caused to flow into the common electrode or storage capacitor electrode by use of the heater controller 37 so as to raise the temperature of the common electrode or storage capacitor electrode.

The common electrode or storage capacitor electrode is formed of a transparent conductive film such as ITO. Since the sheet resistance of the transparent conductive film is relatively high and is several Ω to several tens Ω, the electrode is heated by Joule heat when a voltage of several tens V is applied across the common electrode or storage capacitor electrode to pass a current of several A therethrough.

In the image display period, switches (not shown) between the common electrode and the heater controller 37 and between the storage capacitor electrode and the heater controller 37 are turned OFF. Voltages applied to the common electrode and storage capacitor electrode are respectively controlled by the common electrode driver 35 and storage capacitor electrode driver 60.

The construction of the liquid crystal display element 40 in FIG. 9 is explained. The plan views of the whole portion and one pixel portion of the liquid crystal display element are the same as those shown in FIGS. 3A and 3C of the first embodiment and the explanation therefor is omitted.

Figure 10:
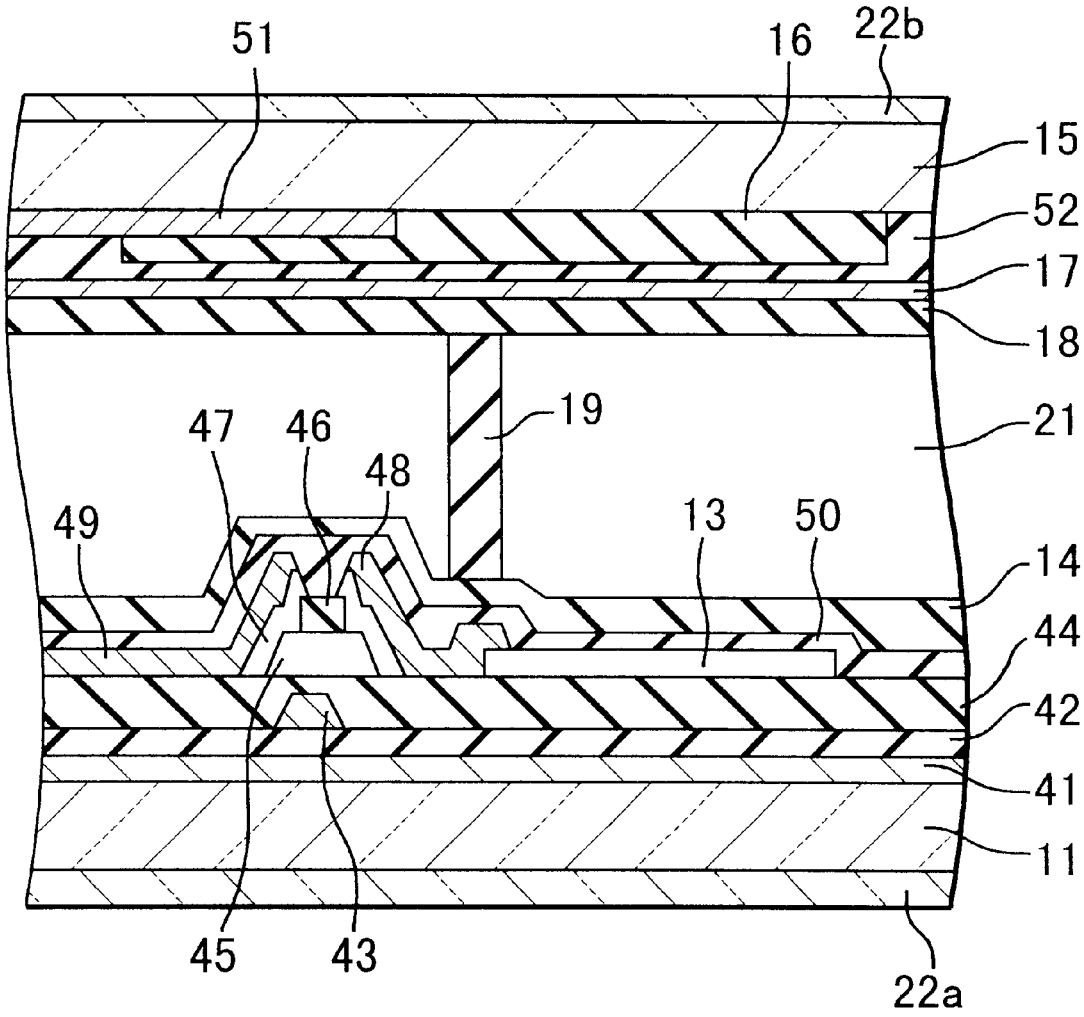
FIG. 10 is a cross sectional view showing the construction of a liquid crystal display element according to the second embodiment of this invention.

As shown in FIG. 10, a storage capacitor electrode 41 formed of a transparent conductive film such as ITO is formed on the entire surface of a display area of a first glass base plate 11. An insulating film 42 of silicon oxide, silicon nitride, polyimide, acrylic, benzocyclobutene polymer or the like, for example, is formed on the entire surface of the storage capacitor electrode 41. Scanning lines 43 are formed on the insulating film 42.

A gate insulating film 44 is formed on the insulating film 42 and scanning lines 43. A thin semiconductor film 45 formed of a thin amorphous silicon film is formed on the gate insulating film 44. A channel protection film 46 formed of a silicon nitride film for protecting the thin film 45 at the time of formation of the channel of the TFT is formed on the thin semiconductor film 45.

A source electrode 48 electrically connected to the thin semiconductor film 45 and a drain electrode 49. integrally formed with the signal line are formed above the thin semiconductor film 45 and channel protection film 46 with ohmic contact layers 47 formed of a heavily doped silicon layer disposed therebetween.

Further, a pixel electrode 13 electrically connected to the source electrode 48 is formed on the gate insulating film 44. In order to prevent the short circuit with the common electrode as will be described later, a protection layer 50 is formed on the entire surface. An alignment film 14 is formed on the protection film 50.

A second glass base plate 15 is arranged in opposition to the switching element side of the first glass base plate 11. A black matrix 51 and color filter 16 are formed on the second glass base[]plate 15. Further, a surface-smoothing resin layer 52 formed of acrylic, benzocyclobutene polymer, polyimide or the like is formed on the entire surface. A common electrode 17 is formed on the surface-smoothing resin layer 52. An alignment film 18 is formed on the common electrode 17.

A structure containing the second glass base plate 15 is held by a spacer pole (stud) 19 formed on the alignment film 14 and a liquid crystal 21 such as a ferroelectric liquid crystal (FLC), antiferroelectric liquid crystal (AFLC), TLAF, DHF or twisted FLC having spontaneous polarization induced by application of an electric field or inherent thereto is inserted between the two structures.

Further, polarizing plates 22*a* and 22*b* are attached to the outside surfaces of the first and second glass base plates 11 and 15.

Like the liquid crystal display device of the first embodiment, an external switch 39 for starting/terminating the alignment treatment is provided in the liquid crystal display device so that the alignment treatment can be started based on the determination of the user. When the user depresses the switch, an alignment treatment starting signal is output from the alignment controller 36 to start the alignment treatment of the liquid crystal.

The display timing controller 30 issues an instruction to the scanning line driver 32 to select all or a plurality of scanning lines when the alignment treatment starting signal is output from the alignment controller 36. Then, it instructs the common electrode driver 35 and storage capacitor electrode driver 60 to apply voltages so as to restore the alignment of liquid crystal molecules.

Figure 11A:
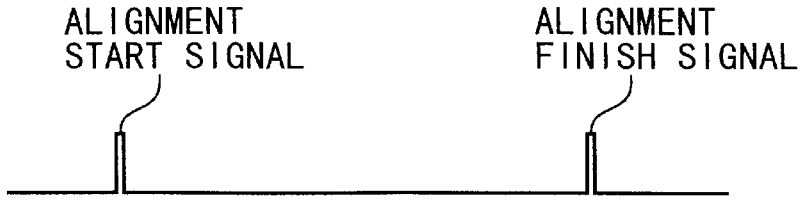
FIGS. 11A to 11F are timing charts of various signals according to the second embodiment.
Figure 11B:
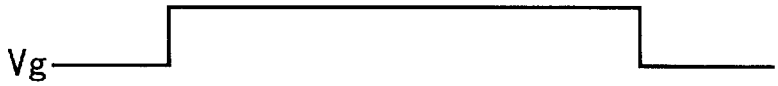

At the time of alignment treatment, a voltage effectively applied to the liquid crystal molecules is a sufficiently high voltage for restoring the alignment. Further, in some cases, an instruction is issued from the alignment controller 36 to the heater controller 37 to warm the liquid crystal element 40. When the alignment treatment starting signal is output from the alignment controller 36 (FIG. 11A), the display timing controller 30 terminates the alignment treatment.

Like the first embodiment, it is possible to output the alignment start signal from the alignment controller 36 at a specified timing, for example, immediately after the liquid crystal display device is turned ON, or when the liquid crystal display device is turned OFF or when a preset period of time has elapsed.

Like the first embodiment, when the liquid crystal display device of this embodiment is used as the display terminal of a computer, an alignment start signal can be output from the alignment controller 36 in response to turn-OFF of the back light or starting of the screen saver while the energy-saving mechanism is activated.

The manufacturing method after the structures are formed on the first and second glass base plates 11 and 15 is the same as that explained in the first embodiment and the explanation therefor is omitted.

In order to exhibit the effect of the alignment of this invention, the liquid crystal alignment was intentionally disturbed by use of the same method as in the first embodiment for the liquid crystal display element formed by the above-described method and then signals shown in FIGS. 11A to 11F were output to the liquid crystal display element from the driver to effect the alignment treatment.

The alignment conditions and alignment results of the alignment treatments for respective samples are shown in FIGS. 12 to 14. The image quality is indicated by A, B, C, D and E in the order of high quality.

(Sample Numbers 11, 12, 13)

Figure 11C:
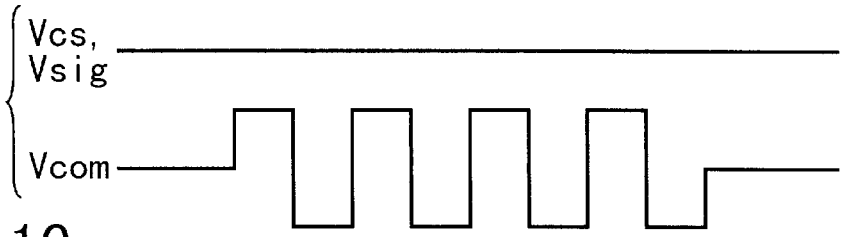

A signal Vg of DC 20V was supplied to all of the scanning lines (FIG. 11B) and signals Vcs and Vsig of 0V were supplied to the storage capacitor electrode and signal line to hold the potential of the pixel electrodes at 0V (FIG. 11C). Then, a rectangular wave signal Vcom (FIG. 11C) of ±5V (Sample Number 11), ±10V (Sample Number 12) or ±15V (Sample Number 13) at 60 Hz was supplied to the common electrode and the alignment treatment was effected.

By effecting the alignment treatment by applying the voltage to the common electrode, a high voltage of ±5V or more could be applied between the storage capacitor electrode and the common electrode and the contrast which was 3:1 before the alignment treatment could be extremely enhanced to 77:1, 110:1 and 220:1 in the respective cases.

Further, by simultaneously selecting all of the scanning lines, the same voltages could be applied to all of the pixels and the alignment treatment could be uniformly effected for the entire surface of the image plane. By normally setting the gate in the ON state, an influence by the feedthrough voltage could be eliminated.

Further, since the storage capacitor electrode is used as one of the electrodes for the alignment treatment, the alignment treatment could be effected not only for the pixels but also for the surrounding portions of the pixels. As a result, undesirable transmission of light through the surrounding portion of the pixel could be prevented and the contrast could be improved by 10% in comparison with a case wherein the alignment treatment was effected by applying the same voltage between the pixel electrode and the common electrode.

(Sample Number 14)

Figure 11D:
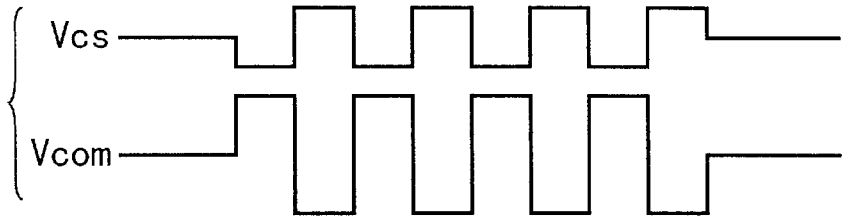

A signal Vg of DC 20V was supplied to all of the scanning lines (FIG. 11B), a rectangular signal Vcs (FIG. 11D) of ±3.5V at 60 Hz was supplied to the storage capacitor electrode and a rectangular signal Vsig of ±2.5V at 60 Hz was supplied to the signal line. Further, a rectangular wave signal Vcom of ±7.5V having a phase difference of 180° with respect to the signals applied to the storage capacitor electrode and signal line was supplied to the common electrode (FIG. 11D).

As a result, a voltage of ±10V could be applied between the pixel electrode and the common electrode and the same effect as that obtained in the case of the sample number 12 could be attained. Since the insulating layer (dielectric) is inserted between the storage capacitor electrode and the pixel electrode, a voltage drop occurs. Therefore, by taking the voltage drop into consideration in order to make the voltages applied to the liquid crystal molecules in the pixel portion and in the pixel surrounding portion (non-pixel electrode portion) substantially equal to each other, Vcs (=±3.5V) which is 1V higher than Vsig (=±2.5V) was supplied.

(Sample Number 15)

A signal Vg supplied to the scanning lines was set to 0V and the switching elements were turned OFF. A rectangular wave signal Vcom of ±10V at 60 HZ was supplied to the common electrode and a signal Vcs supplied to the storage capacitor electrode was set to 0V.

In this condition, since the pixel electrodes were set in the electrically floating state and the storage capacitor electrode was held at substantially 0V, the same effect as that in the sample number 12 could be attained.

(Sample Number 16)

A signal Vg supplied to the scanning lines was set to 0V and the switching elements were turned OFF. A rectangular wave signal Vcs of ±3.5V at 60 HZ was supplied to the storage capacitor electrode. Further, a rectangular wave signal Vcom of ±7.5V having a phase difference of 180° with respect to the signals applied to the storage capacitor electrode was supplied to the common electrode (FIG. 11D).

In this condition, the pixel electrodes were set in the electrically floating state, but since the potential of the electrode was changed according to a change in the signal Vcs supplied to the storage capacitor electrode, the same effect as that in the sample number 12 could be attained.

(Sample Numbers 17, 18)

The conditions of the above samples are the same as that of the sample number 12 except that the frequency of a signal Vcom supplied to the common electrode is changed to 1 Hz (Sample Number 17) or 200 Hz (Sample Number 18).

With the above samples, the same effect as that of the sample number 12 could be attained. It is preferable to set the signal Vcom supplied for the alignment treatment in a range of 0.01 Hz to 500 Hz when the frequency is thus changed. Particularly, the effect becomes significant in the range of 0.1 Hz to 200 Hz, and more particularly, the frequency range of 10 Hz to 40 Hz is preferable when taking simplicity of formation of the circuit and time required for the alignment treatment into consideration.

(Sample Numbers 19, 20)

The conditions of the above samples are the same as that of the sample number 12 except that the waveform of a signal Vcom supplied to the common electrode is changed to a triangular wave (Sample Number 19) or sinusoidal wave (Sample Number 20).

With the above samples, the same effect as that of the sample number 12 could be attained.

(Sample Numbers 11-2 to 20-2)

The conditions of the above samples correspond to cases wherein the panel temperatures in the sample numbers 11 to 20 are changed.

The panel temperature was raised to 50° C. by passing a current from the heater controller to the common electrode or storage capacitor electrode before the voltage application alignment treatment was effected. After this, the panel temperature was returned to the room temperature for 10 minutes by natural heat radiation. During the heat radiation, the signals Vcs, Vg, Vsig, Vcom shown in FIG. 13 were supplied and the alignment treatment was effected. The effect of the alignment treatment was improved in comparison with the sample numbers 11 to 20 since the motion of liquid crystal molecules became more active when the panel temperature was raised.

(Sample Numbers 11-3 to 20-3)

The conditions of the above samples correspond to cases wherein only the panel temperatures in the sample numbers 11-2 to 20-2 are changed.

The panel temperature was raised to 90° C. by passing a current from the heater controller to the common electrode or storage capacitor electrode before the voltage application alignment treatment was effected. After this, the panel temperature was returned to the room temperature for 20 minutes by natural heat radiation. During the heat radiation, the signals Vcs, Vg, Vsig, Vcom shown in FIG. 14 were supplied and the alignment treatment was effected. It was confirmed that the effect of the alignment treatment was improved since the motion of liquid crystal molecules became more active when the panel temperature was raised.

In the above samples, the liquid crystal display element was heated to the phase transfer temperature of the liquid crystal or more and the liquid crystal material was once set into the isotropic phase. As a result, since the liquid crystal alignment was entirely reset, the effect of the alignment treatment could be extremely improved. Heating to approximately 90° C. did not degrade the members of the liquid crystal display device such as the plastic-made casing or polarization plate.

Next, the evaluation result of comparison samples using the conventional liquid crystal display device is explained. In this case, in the above comparison samples, the same voltage as that applied to the common electrode is applied to the storage capacitor electrode.

(Comparison Sample C11)

Figure 11E:
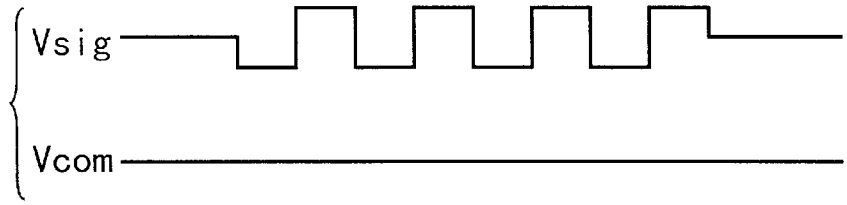

A rectangular wave signal Vsig was applied to the signal line while a signal Vcom supplied to the common electrode was kept constant (FIG. 11E). Since the withstand voltage of the normal signal line driver was 5V, only a maximum of ±2.5V could be applied as the signal Vsig supplied to the signal line and the alignment treatment could not be sufficiently effected. Further, in the present comparison sample, the scanning lines were driven based on the line-at-a-time scanning method. That is, a pulse wave (Vg1=−5V, Vgh=20V, period=60 Hz, write time=42 μs) as shown in FIG. AF was applied to the scanning lines. Since the write time was shorter than the response time (80 μs) of the liquid crystal, the potential of the pixel electrode was lowered in the non-selected period and a voltage necessary for the alignment treatment could not be applied to the liquid crystal.

Further, by the lowering in the potential of the pixel eletrode, an influence by the delay of the gate signal became significant, the alignment treatment could not be uniformly effected and the image quality was lowered.

(Comparison Sample C12)

A signal Vcom supplied to the common electrode was set at a constant level and a rectangular wave signal Vsig of ±5V was supplied to the signal line (FIG. 11E). If a voltage of ±5V was applied to the signal line by use of the special signal line driver as in this condition, it became necessary to raise a signal Vgh in order to prevent a lowering in the ON-resistance of the TFT. As a result, the reliability of the TFT was lowered. Further, the image quality became irregular due to a fluctuation in the TFT characteristics.

Figure 11F:
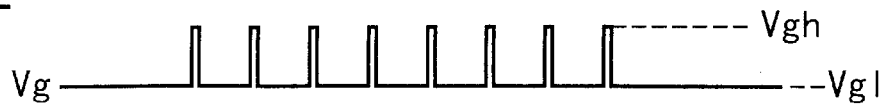

Further, in the present comparison sample, the scanning lines were driven based on the line-at-a-time scanning method. That is, a pulse wave (Vg1=−5V, Vgh=25V, period=60 Hz, write time (in which Vgh is output)=42 μs) as shown in FIG. 11F was applied to the scanning lines. Since the write time was shorter than the response time (80 μs) of the liquid crystal, the potential of the pixel electrode was lowered in the non-selected period (in which the scanning line voltage is set at Vg1) and a voltage necessary for the alignment treatment could not be applied to the liquid crystal.

Further, an influence by the delay of the gate signal due to the lowering in the potential of the pixel electrode became significant, the alignment treatment could not be uniformly effected and the image quality was lowered.

(Comparison Sample C13)

A rectangular wave signal Vsig of ±2.5V at 60 Hz was supplied to the signal line and a rectangular wave signal Vcom of ±2.5V having a phase difference of 180° with respect to the signal supplied to the signal line was supplied to the common electrode. Therefore, a voltage of ±5V could be written between the pixel electrode and the common electrode.

However, in the present comparison sample, the scanning lines were driven based on the line-at-a-time scanning method. That is, a signal (Vg1=−5V, Vgh=20V, period=60 Hz, write time=42 μs) as shown in FIG. 11F was applied to the scanning line.

Since the write time was shorter than the response time (80 μs) of the liquid crystal, the potential of the pixel electrode was lowered in the non-selected period (in which the scanning line voltage was set at Vg1) and a voltage necessary for the alignment treatment could not be applied to the liquid crystal.

Further, an influence by the delay of the gate signal due to the lowering in the potential of the pixel electrode became significant, the alignment treatment could not be uniformly effected and the image quality was lowered.

(Comparison Samples C14, C15, C16)

The conditions of the above samples correspond to cases wherein the panel temperatures in the comparison samples C11 to C13 are changed. The panel temperature was raised to 50° C. by passing a current from the heater controller to the common electrode or storage capacitor electrode before the voltage application alignment treatment was effected. After this, the panel temperature was returned to the room temperature for 10 minutes by natural heat radiation. During the heat radiation, the signals Vg, Vsig, Vcom were supplied and the alignment treatment was effected. The contrast was improved since the motion of liquid crystal molecules became active when the panel temperature was raised, but the alignment treatment became irregular and the image quality was low.

(Comparison Samples C17, C18, C19)

The conditions of the above comparison samples correspond to cases wherein the panel temperatures in the comparison samples C14 to C16 are changed. The panel temperature was raised to 90° C. by passing a current from the heater controller to the common electrode or storage capacitor electrode before the voltage application alignment treatment was effected. After this, the panel temperature was returned to the room temperature for 20 minutes by natural heat radiation. During the heat radiation, the signals Vg, Vsig, Vcom shown in FIG. 15 were supplied and the alignment treatment was effected. The contrast was improved since the motion of liquid crystal molecules became active when the panel temperature was raised, but the alignment was irregular and the image quality was low.

Next, an example in which a voltage higher than that applied to the common electrode was applied to the storage capacitor electrode of the liquid crystal display device of this embodiment and the alignment treatment was effected is explained. The conditions and results of the alignment treatments are shown in FIG. 16.

(Sample Numbers 21 to 23)

The paths between the scanning line driver and the display timing controller and between the signal line driver and the display timing controller were cut OFF and the scanning lines, signal lines and pixel electrodes were set into the electrically floating state. The common electrode was held at 0V. Then, a rectangular wave signal Vcs of ±5V (Sample Number 21), ±10V (Sample Number 22) or ±15V (Sample Number 23) at 60 Hz was supplied to the storage capacitor electrode and the alignment treatment was effected.

By effecting the alignment treatment by applying the voltage via the storage capacitor electrode, a voltage of ±5V or more could be uniformly applied between the storage capacitor electrode and the common electrode and the contrast which was 3:1 before the alignment treatment could be extremely increased.

Further, since the pixel electrodes were set into the electrically floating state, the same voltage could be applied to all of the pixels and pixel surrounding portions and the alignment treatment could be uniformly effected for the entire image plane. Since the scanning lines were set into the electrically floating state, an influence by the feedthrough voltage could be eliminated. Further, since the storage capacitor electrode was used as one of the electrodes for the alignment treatment, the alignment treatment could be effected not only for the pixels but also for the pixel electrode surrounding portions. As a result, undesirable transmission of light through the pixel surrounding portion could be prevented.

(Sample Number 24)

In this sample, the paths between the scanning line driver and the display timing controller and between the signal line driver and the display timing controller were cut OFF and the scanning lines, signal lines and pixel electrodes were set into the electrically floating state. A rectangular wave signal Vcs of ±7.5V at 60 Hz was supplied to the storage capacitor electrode. A rectangular wave signal Vcom of ±2.5V having a phase difference of 180° with respect to the voltage applied to the storage capacitor electrode was supplied to the common electrode. As a result, a voltage of ±10V could be applied between the storage capacitor electrode and the common electrode and the same effect as that obtained in the sample number 22 could be attained.

(Sample Number 25)

In this sample, a signal Vg supplied to the scanning lines was set at 0V so as to set the TFT into the non-selected state (OFF state), a rectangular wave signal Vcs of ±10V at 60 Hz was supplied to the storage capacitor electrode and a signal Vcom supplied to the common electrode was set at 0V.

According to this condition, the pixel electrodes were set into the electrically floating state, but since the common electrode was held at substantially 0V, the same effect as that obtained in the sample number 22 could be attained.

(Sample Number 26)

In this sample, a signal Vg of DC 20V was supplied to all of the scanning lines so as to turn ON all of the TFTs, a rectangular wave signal Vcs of ±7.5V at 60 Hz was supplied to the storage capacitor electrode and a rectangular wave signal Vsig of ±6.5V at 60 Hz was supplied to the signal line. Further, a rectangular wave signal Vcom of ±2.5V having a phase difference of 180° with respect to the signal Vsig supplied to the signal line was supplied to the common electrode.

According to this condition, a voltage of ±10V could be applied between the pixel electrode and the common electrode and the same effect as that obtained in the sample number 22 could be attained.

A voltage drop occurs since the insulating layer (dielectric) is formed between the storage capacitor electrode and the pixel electrode. By taking the voltage drop into consideration in order to make the voltages applied to the liquid crystal molecules in the pixel portion and in the pixel electrode surrounding portion (non-pixel electrode portion) substantially equal to each other, the signal Vcs (±7.5V) was set higher than the signal Vsig (±6.5V) by 1V.

(Sample Numbers 27, 28)

The conditions of the sample numbers 27 and 28 were similar to that of the sample number 22 except that the frequency of the signal Vcs supplied to the storage capacitor electrode was changed to 1 Hz (Sample Number 27) or 200 Hz (Sample Number 28).

According to the above condition, the same effects as that of the sample number 22 could be obtained. When the frequency is thus changed, it is preferable to set the signal Vcs supplied to the storage capacitor electrode to 0.01 Hz to 500 Hz. Particularly, in the range of 0.1 Hz to 200 Hz, the effect is significant, and a frequency of 10 Hz to 40 Hz is more preferable when taking the simplicity of formation of the circuit and time required for the alignment treatment into consideration.

(Sample Numbers 29, 30)

The conditions of the sample numbers were similar to that of the sample number 22 except that the waveform of a signal Vcs supplied to the storage capacitor electrode was changed to a triangular wave (Sample Number 29) or sinusoidal wave (Sample Number 30).

In the above conditions, substantially the same effects as that of the sample number 22 could be obtained.

(Sample Numbers 21-2 to 30-2)

The conditions of the above samples correspond to cases wherein the panel temperatures of the sample numbers 21 to 30 are changed.

The panel temperature was raised to 50° C. by passing a current from the heater controller to the common electrode or storage capacitor electrode before the voltage application alignment treatment was effected. After this, the panel temperature was returned to the room temperature for 10 minutes by natural heat radiation. During the heat radiation, the signals Vcs, Vg, Vsig, Vcom shown in FIG. 17 were supplied to effect the alignment treatment. The effect of the alignment treatment became significant since the motion of liquid crystal molecules became more active when the panel temperature was raised.

(Sample Numbers 21-3 to 30-3)

The conditions for samples correspond to cases. wherein the panel temperatures are changed in the sample numbers 21-2 to 30-2.

The panel temperature was raised to 90° C. by passing a current from the heater controller to the common electrode or storage capacitor electrode before the voltage application alignment treatment was effected. After this, the panel temperature was returned to the, room temperature for 10 minutes by natural heat radiation. During the heat radiation, the signals Vcs, Vg, Vsig and Vcom shown in FIG. 18 were supplied to effect the alignment treatment. The effect of the alignment treatment became significant since the motion of liquid crystal molecules became more active when the panel temperature was raised.

In the above conditions, the liquid crystal display element was heated to the phase transfer temperature of the liquid crystal or more and the liquid crystal material was once set into the isotropic phase. As a result, since the liquid crystal alignment was entirely reset, the effect of the alignment treatment could be extremely improved. Heating to approximately 90° C. did not degrade the members of the liquid crystal display device such as the plastic-made casing or polarization plate.

In the above embodiment, the storage capacitor electrode 41 which is formed with an area larger than that of the pixel electrode 13 between the first glass base plate 11 and the pixel electrode 13 is used as one of the electrodes for applying a voltage to the liquid crystal at the time of alignment. Therefore, the alignment treatment can also be effected for the surrounding portions of the pixel electrodes 13 and undesirable transmission of light in the surrounding portions of the pixel electrodes can be prevented to enhance the contrast. Further, the black matrix 51 which prevents transmission of light in the pixel surrounding portion can be formed with a small area and the opening ratio can be enhanced.

This invention is not limited to the above embodiments. For example, in the above embodiments, the number of scanning lines to be selected is set to two or half of the whole scanning lines, but the number of scanning lines to be selected may be two or more. However, it is preferably set the number of scanning lines to 10 or more.

Further, as the switching element, MIM or TFD can be used instead of TFT.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A liquid crystal display device driven in a display mode and a display suspended period, comprising:

a first base plate;

a pixel electrode on said first base plate;

a scanning line on said first base plate;

a signal line on said first base plate;

a switching transistor having a gate electrode connected to said scanning line, a drain connected to said signal line and a source connected to said pixel electrode;

a liquid crystal material formed on said pixel electrode, said liquid crystal material having spontaneous polarization induced by application of an electric field or inherent polarization;

a common electrode formed on said liquid crystal material;

a second base plate formed on said common electrode; and an alignment treatment controller outputting an alignment start signal and an alignment finish signal separately, wherein an alignment voltage between said pixel electrode and said common electrode is applied in a period between said alignment start signal and said alignment finish signal in said display suspended period, to make an alignment such that rod-like molecules of said liquid crystal material are arranged in a layered form and set in substantially parallel to one another, and a maximum absolute value of said alignment voltage is larger than a maximum absolute value of a display voltage applied between said pixel electrode and said common electrode in said display mode.

2. A liquid crystal display according to claim 1, further comprising:

a display timing controller connected to a scanning line driver, a signal line driver, a common electrode driver and said alignment treatment controller, wherein said scanning line driver is connected to said scanning line, said signal line driver is connected to said signal line and said common electrode driver is connected to said common electrode.

3. A liquid crystal display according to claim 2, comprising:

a plurality of pixel electrodes on said first base plate;

a plurality of scanning lines on said first base plate; and a plurality of signal lines on said first base plate, wherein said scanning line driver selects adjacent said scanning lines.

4. A liquid crystal display according to claim 3, wherein said scanning line driver selects at least ten of said scanning lines in said non-display mode.

5. A liquid crystal display according to claim 3, wherein said selected scanning lines include a portion in which alignment of said liquid crystal material is disturbed or in which image sticking is generated.

6. A liquid crystal display according to claim 1, wherein said liquid crystal material is selected from a group of a ferroelectric liquid crystal, an antiferroelectric liquid crystal, a thresholdless antiferroelectric liquid crystal, a deformed-helix ferroelectric liquid crystal and twisted ferroelectric liquid crystal.

7. A liquid crystal display according to claim 1, wherein said alignment start signal is output in cooperation with an energy-saving mechanism.

8. A liquid crystal display according to claim 1, wherein a phase difference between electrical potentials of said pixel electrode and said common electrode is 180 degrees.

9. A liquid crystal display device according to claim 1, further comprising means for heating said liquid crystal material.

10. A liquid crystal display device according to claim 9, wherein said heating means contains said common electrode.

11. A liquid crystal display device according to claim 1, further comprising:

an external switching circuit for controlling said alignment treatment controller.

12. A liquid crystal display according to claim 1, further comprising:

a heater driver, wherein said heater driver supplies electric power.

13. A liquid crystal display according to claim 12, further comprising:

a sheet-like heater to supply heat to said liquid crystal material.

14. A liquid crystal display according to claim 1, further comprising:

an external switching circuit for controlling said alignment treatment controller.

15. A liquid crystal display device driven in a display mode and a display suspended period, comprising:

a first base plate;

a pixel electrode on said first base plate;

a scanning line on said first base plate;

a signal line on said first base plate;

a switching transistor having a gate electrode connected to said scanning line, a drain connected to said signal line and a source connected to said pixel electrode;

a liquid crystal material formed on said pixel electrode, said liquid crystal material having spontaneous polarization induced by application of an electric field or inherent polarization;

a common electrode formed on said liquid crystal material;

a second base plate formed on said common electrode;

an alignment treatment controller outputting an alignment start signal and an alignment finish signal separately;

a transparent storage capacitor electrode formed in an entire display area on said first base plate; and an insulating film formed between said transparent storage capacitor electrode and said pixel electrode, wherein an alignment voltage between said transparent storage capacitor electrode and said common electrode is applied in a period between said alignment start signal and said alignment finish signal in said display suspended period, to make an alignment such that rod-like molecules of said liquid crystal material are arranged in a layered form and set in substantially parallel to one another, and a maximum absolute value of said alignment voltage is larger than a maximum absolute value of a display voltage applied between said pixel electrode and said common electrode in said display mode.

16. A liquid crystal display according to claim 15, further comprising:

a plurality of pixel electrodes on said first base plate;

a plurality of scanning lines on said first base plate;

a plurality of signal lines on said first base plate; and a black matrix formed in spaces between said pixel electrodes.

17. A liquid crystal material alignment method for a display device having a pixel electrode, a liquid crystal material formed on said pixel electrode, said liquid crystal material having spontaneous polarization induced by application of an electric field or inherent polarization, a common electrode formed on said liquid crystal material, and an alignment treatment controller outputting alignment start signal and an alignment finish signal separately, comprising:

applying an alignment voltage between said pixel electrode and said common electrode in a display suspended period, wherein a maximum absolute value of said alignment voltage is larger than a maximum absolute value of a display voltage applied between said pixel electrode and said common electrode in a display mode.

18. A liquid crystal material alignment method according to claim 17, wherein a constant voltage is applied to one of said pixel electrode and said common electrode and a rectangular waveform voltage is applied to the other of said pixel electrode and said common electrode.

19. A liquid crystal material alignment method according to claim 17, wherein rectangular wave form voltages are applied to said pixel electrode and said common electrode, and a phase difference between voltages at said pixel electrode and said common electrode is 180 degrees.

20. A liquid crystal material alignment method according to claim 17, further comprising: heating said liquid crystal material in said display suspended period.

21. A liquid crystal alignment method according to claim 17, the step of applying an alignment voltage between said pixel electrode and said common electrode in a display suspended period includes a step of heating said liquid crystal material to 50° C. or less.

22. A liquid crystal alignment method according to claim 17, the step of applying an alignment voltage between said pixel electrode and said common electrode in a display suspended period is performed at a room temperature.

23. A liquid crystal alignment method for a display device having a pixel electrode, a liquid crystal material formed on said pixel electrode, said liquid crystal material having spontaneous polarization induced by application of an electric field or inherent polarization, a common electrode formed on said liquid crystal material, an alignment treatment controller outputting alignment start signal and an alignment finish signal separately, and a transparent storage capacitor electrode formed in an entire display area under said pixel electrode with an insulating film interposed there between, comprising;

applying an alignment voltage between said transparent capacitor electrode and said common electrode in a display suspended period, wherein a maximum absolute value of said alignment voltage is larger than a maximum absolute value or a display voltage applied between said pixel electrode and said common electrode in a display mode.

24. A liquid crystal alignment method according to claim 23, the step of applying an alignment voltage between said transparent capacitor electrode and said common electrode in a display suspended period includes a step of heating said liquid crystal material at 50° C. or less.

25. A liquid crystal alignment method according to claim 23, the step of applying an alignment voltage between said transparent capacitor electrode and said common electrode in a display suspended period is performed at a room temperature.

26. A liquid crystal alignment method according to claim 23, the step of applying an alignment voltage between said transparent capacitor electrode and said common electrode in a display suspended period is performed for ten minutes.

* * * * *